United States Patent [19]

Ishii

[11] Patent Number: 4,809,039

[45] Date of Patent: Feb. 28, 1989

[54] ELECTROSTATIC IMAGE RECORDING APPARATUS WITH A SHIFTABLE REFERENCE IMAGE

[75] Inventor: Kimiyasu Ishii, Kawasaki, Japan

[73] Assignee: Ricoh Company, Ltd., Tokyo, Japan

[21] Appl. No.: 123,322

[22] Filed: Nov. 20, 1987

[30] Foreign Application Priority Data

Nov. 20, 1986 [JP] Japan ..... 61-277742
Jan. 20, 1987 [JP] Japan ..... 62-11180

[51] Int. Cl.[4] ..... G03G 15/00
[52] U.S. Cl. ..... 355/14 R; 355/7
[58] Field of Search ..... 355/7, 8, 14 SH, 14 R, 355/14 C, 14 D

[56] References Cited

U.S. PATENT DOCUMENTS 4,536,079 8/1985 Lippolis et al. ..... 355/14 C X
4,684,243 8/1987 Minor ..... 355/14 D X
4,707,109 11/1987 Kanno et al. ..... 355/14 R X

*Primary Examiner*—Arthur T. Grimley
*Assistant Examiner*—J. Pendegrass
*Attorney, Agent, or Firm*—Oblon, Fisher, Spivak, McClelland & Maier

[57] ABSTRACT

An electrostatic recording apparatus capable of setting any desired position on a recording medium for transferring a toner image, and a device for controlling the amount of toner supply in two-component development. A position for forming a reference latent image potential is shifted relatively based on shift data which is representative of a position for transferring the toner image of a potential corresponding to a document image to the recording medium, whereby rapid recording is promoted and, yet, adequate developer density control is achieved.

10 Claims, 30 Drawing Sheets

A
#KEY ON?
YES
NO
F1a = 1 ?
YES
F1a ← 0
NO
F1b = 1 ?
YES
F1b ← 0
NO
PROCESSING CORRESPONDING TO OTHER #KEY INPUTS
CENTERING KEY ON?
YES
F2 = 1 ?
YES
F2 ← 0
NO
F2 ← 1, F3, F4 ← 0
NO
RA3 ← RA2/RA1
DOCUMENT KEY ON?
YES
RA3 ≧ 2.00 ?
YES
RG1 ← 2.00
NO
RA3 ≦ 0.50 ?
YES
RG1 ← 0.50
NO
RG1 ← RA3
NO
RG2 ≧ 6 ?
NO
RG2 ← RG2 + 1
YES
RG2 ← 0
1

ELECTROSTATIC IMAGE RECORDING APPARATUS WITH A SHIFTABLE REFERENCE IMAGE

BACKGROUND OF THE INVENTION

The present invention relates to a copier and other electrostatic image recording apparatuses of the type capable of transferring a toner image to any desired position on a recording medium. Also, in such an image recording apparatus, the present invention relates to a device for detecting the density of a developer which is used to produce a visible image, more specifically an implement for controlling the amount of toner supply in a development system of the kind using a two-component developer, i.e. a mixture of toner and magnetic carrier for carrying the toner.

In an electrostatic recording apparatus, it is a common practice to produce a reproduction of a desired image by a sequence of steps of forming an electrostatic latent image corresponding to the desired image on a photoconductive element or like charger carrier, depositing charged toner on the latent image, and transferring the resulting toner image to a recording medium such as a copy sheet. In a copier, for example, a photoconductive element is uniformly charged to a predetermined polarity, then it is exposed imagewise to electrostatically form a latent image, then toner is applied to the latent image, and then the resulting toner image is transferred to a coy sheet.

In a developing system of the kind using toner and carrier as stated earlier, the carrier carrying the toner is magnetically deposited on the periphery of a developing roller, which is in rotation, to form a so-called magnetic brush. The magnetic brush is brought into contact with the surface of a charge carrier so that the charged toner is electrostatically adhered to a latent image. Such a two-component developing principle is extensively applied to electrostatic image recording apparatuses of the type described. Specifically, a developing unit is provided with a reservoir in which toner and carrier are stored in a predetermined mixture ratio. A paddle wheel or the like is installed in the reservoir for agitating the toner-carrier mixture, or developer, thereby charging to toner to a predetermined polarity. Needless to mention, since only the toner is deposited on a latent image during development, the density of developer in the reservoir changes at each time of development. Microscopically, therefore, the developer density continuously changes even in the same image. So long as use is made of a large reservoir to make the amount of developer sufficiently greater than that of toner which is applied to one latent image, the microscopic change mentioned above is negligible. It is impractical, however, to use an infinitely large reservoir. For this reason, it has been customary to supply toner by detecting the developer density at a certain period. While various approaches have heretofore been proposed for such a kind of developer density control, the approach which will be described hereinafter appears most preferable.

Specifically, in a prior art electrostatic copier, a reference density pattern is provided in a certain region of a document reading surface other than that which corresponds to the leading end of an original document. At the instant when a document is to be scanned, the reference density pattern is optically scanned to form a latent image thereof on a photoconductive element, or charge carrier, the latent image being developed to become a toner image. Then, the reflectivity of the toner image is sensed by a reflection type photosensor. The level read so is compensated based on the amount of scanning light, charging level, developing bias and others and, subsequently, compared with a reference density level. If the actual level is lower than the reference level, an amount of toner matching with the drop of the level is supplemented with the developer density decided to have been lowered. This kind of developer density control can be implemented with a simple construction because a sensor for directly sensing the developer density in the reservoir is needless.

It is sometimes desired to extract or erase a part of images which are printed on an original document or even to move the position for recording it, in order to produce a so-called edited copy. An edited copy is readily attainable with an image processor of the type reading images on a document, converting them into image data, storing the image data in a mass storage, and activating, for example, a laser printer by the image data which are suitably read out of the storage as instructed by an operator. Such is impracticable, however, with an ordinary copier of the kind which directly guides a reflection from a document, which is laid on a glass platen, to a photoconductive element for thereby forming an electrostatic latent image on the photoconductive element (this kind copier will hereinafter be simply referred to as a copier). Specifically, in a copier, an operator cuts out a desired part of a document or removes the other part, then adheres it to a suitable paper (equal in size to a copy sheet in the case of 1 magnification), and then copies the paper. Alternatively, to simply bodily shift document images, the operator sets up an imaginary area on the glass platen which is equal to the size of a copy sheet and, then, positions a document based on the imaginary area. For example, assuming that an person desires to copy a document of format A4 by 1 magnification in the central area of a copy sheet of format A3, he or she assumes an area which is equal to format A3 on the glass platen and, then, sets the document such that the orthogonal lines of the document align with those of the imaginary area.

However, the procedure described above is not only inaccurate but also troublesome and, moreover, setting a document taking account of a magnification change (enlargement or reduction) is unmanageable by unskilled persons without wasting many papers for testing. Further, in a copier furnished with an automatic document feeder (ADF), the ADF is unusable. For the above reasons, there is an increasing demand for automatic processing.

Generally, in a copier, an image to be recorded on a copy sheet may be moved by shifting a toner image on a photoconductive element and a copy sheet relative to each other. Stated another way, the image can be moved by controlling the scanning timing and the sheet feeding timing.

A problem with such a scheme is that since in a prior art copier scanning depends on the size of a copy sheet, it is impossible to feed a copy sheet ahead of a toner image without entailing extra scanning and, therefore, without lowering the copying speed.

Further, a problem is also brought about when the developer density is sensed. In a prior art copier, the reference pattern located in the particular region of a document reading surface as previously stated is scanned to form its latent image on a photoconductive element. Specifically, assuming that the distance between the leading end of a document and the reference pattern is l and the ratio of magnficiation change is N, the latent image of the reference pattern is formed in a position ahead of the latent image corresponding to the leading end of the document by a distance of Nl. This sometimes causes the toner image of the reference pattern to be recorded on a copy sheet, i.e., adequate control over the developer density is impracticable.

SUMMARY OF THE INVENTION

It is, therefore, an object of the present invention to provide an improved electrostatic image recording apparatus which allows a person to set up a position for recording a toner image on a recording medium as desired.

It is another object of the present invention to provide an electrostatic recording apparatus which allows a person to set up a position for recording a toner image on a recording medium as desired and, yet, prevents a needless latent image from being formed while increasing the recording speed as far as possible.

It is another object of the present invention to provide a developer density control device for a recording apparatus of the type capable of setting up any desired position for recording a toner image on a recording medium, for adequately controlling developer density.

In accordance with the present invention, an electrostatic image recording apparatus comprises a charge carrier, a record latent image potential forming means for forming a record latent image potential on the charge carrier which corresponds to an image to be recorded, a developing means for producing a visible image corresponding to the record latent image potential on the charge carrier, a transferring means for transferring the visible image to a predetermined recording medium, a data setting means for setting recording size data which includes at least according length data, an inputting means for inputting in the recording medium shift data which is representative of a position for transferring the visible image, and a recording control means for controlling at least the record latent image potential forming means and transferring means such that, assuming a position on the charge carrier which corresponds to a leading end of the recording medium is a transfer start position, and a position which is rearward of the transfer start position by the recording length is a transfer end position, a record latent image potential formation start timing and a record latent image potential formation end timing are set based on the input shift data, a command for starting formation of the record latent image potential is applied to the record latent image potential forming means based on the record latent image formation start timing set and, subsequently, a command for ending formation of the record latent image potential is applied to the record latent image potential forming means based on the record latent image potential formation end timing set.

In accordance with the present invention, a device installed in an image recording apparatus for controlling developer density comprises a charge carrier, a reference latent image potential forming means for forming a reference latent image potential in a relatively small area of the charge carrier, a record latent image potential forming means for forming on the charge carrier a record latent image potential corresponding to an image which is to be recorded, a developing means for producing visible images each corresponding to a respective one of the reference latent image potential and record latent image potential which are produced on the charge carrier, a developer density adjusting means for adjusting density of a developer which is stored in the developing means, an optical sensing means located downstream of the developing means to face the charge carrier, a transferring means for transferring the visible image of the record latent image potential to a predetermined recording medium, an inputting means for inputting shift data which is representative of a position for transferring the visible image of the record latent image potential to the recording medium, and a control means for setting a record latent image potential form timing, a transfer timing and a reference latent image potential form timing based on the input shift data, and controlling the reference latent image forming means at the reference latent image potential form timing, the record latent image potential forming means at the record latent image potential form timing, and the transferring means at the transfer timing, and controlling the developer density adjusting means based on density of the visible image of the reference latent image potential which is sensed by the optical sensing means.

The above and other objects, features and advantages of the present invention will become more apparent from the following detailed description taken with the accompanying drawings.

DESCRIPTION OF THE PREFERRED EMBODIMENT

To better understand the present invention, problems particular to the prior art will be described first with reference to the accompanying drawings.

Assume that a person desires to copy an image printed on a document of format A4 on a recording medium of format A3 by 1 magnification. In this case, as previously mentioned, the person sets up an imaginary area of an A3 recording medium on a glass platen, as indicated by a dashed line in FIG. 1. Then, he or she positions the document by estimation such that the diagonal lines of the document, which is indicated by a dash-and-dots line in FIG. 1, align with those of the imaginary A3 area on the glass platen. As stated earlier, this kind of work is inaccurate and troublesome and, moreover, setting a document taking account of a magnification change (enlargement or reduction) is unmanageable for unskilled persons without wasting many copy sheets for testing. Further, in the case of a copier furnished with an ADF, the ADF is simply wasted.

In the case where an image to be recorded on a copy sheet is to be moved, a toner image on a photoconductive element and a copy sheet are related with each other in the event of image transfer, as follows.

Figure 2A:
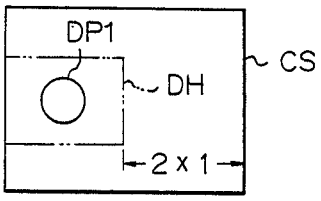
FIGS. 2A, 2B, 2C, 3A, 3B, 3C, 4A, 4B, 4C, 5A, 5B and 5C are schematic views showing various relative positions of a toner image corresponding to a reference density pattern and an area corresponding to a document image and a copy sheet.
Figure 2B:
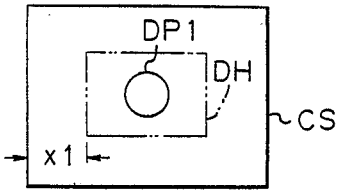
Figure 3A:
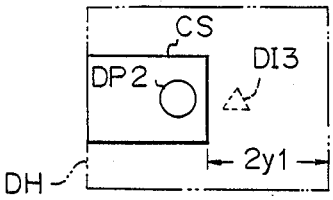

FIG. 2A shows a copy sheet CS and an area DH of document (with a magnification change taken into account) which is projected onto the copy sheet CS, in a condition wherein the copy sheet CS and the area DH are not offset relative to each other. In FIG. 2A, the copy sheet CS is assumed to be fed in the horizontal direction, the left side being the upstream side. Since the area DH is smaller than the copy sheet CS, an image positioned at the center of the document is reproduced as an image DP1 adjacent to the left end of the copy sheet CS. In this condition, the area DH and the copy sheet CS are different in size from each other by 2x1 in the sheet feed direction. Hence, when the copy sheet CS is fed at such a timing that is precedes the area DH by x1, the area DH is brought to the center of the copy sheet CS so that the image DP1 is recorded in the center of the copy sheet CS, as shown in FIG. 2B. FIG. 3A shows a copy sheet CS and an area DH of document (with a magnification change taken into account) projected onto the same plane as the copy sheet CS and larger in size than the copy sheet CS, in a condition wherein the toner image and the copy sheet are not offset relative to each other. As shown, the copy sheet CS and the area DH are different in size from each other by 2y1 in the sheet feed direction. In this case, while a left one (circle) of two image fragments which are positioned at the center of the document is barely reproduced as an image DP2 adjacent to the right end of the copy sheet CS, the other image (triangle) is not reproduced although its latent image DI3 is formed. In such a condition, when the copy sheet CS is fed at such a timing that it follows the area DH by y1, the copy sheet CS is brought to the center of the area DH so that both the image fragments DP2 and DP3 are printed in the center of the copy sheet CS.

Figure 3B:
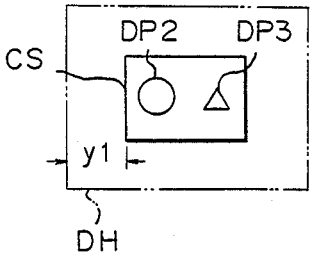

The movement of the image as shown in any of FIGS. 2B and 3B may be automatically effected by entering a document image size, a ratio of magnification change, and a copy sheet size as data. More generally, an image to be recorded can be moved as desired only if data representative of an amount of movement is entered.

Figure 4A:
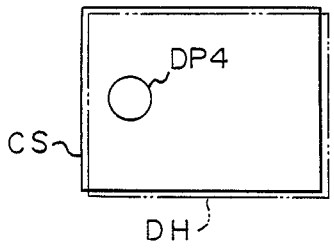
Figure 4B:
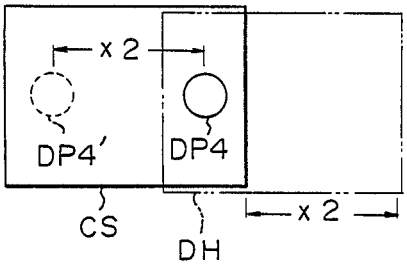
Figure 5A:
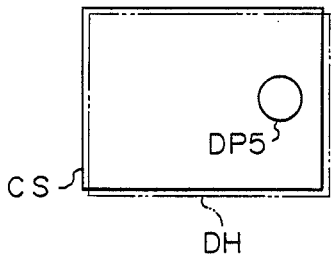

FIG. 4A shows a copy sheet CS and an area DH of document (with a magnification change taken into account) which is projected onto the same plane as the copy sheet CS, in a condition wherein the toner image and the copy sheet are not offset relative to each other. In the figure, the copy sheet CS and the area DH are shown as being deviated in position to facilitate an understanding. When it is desired to move the image DP4 to the right by x2, the copy sheet CS is fed at such a timing that it precedes the area DH by x2 based on shift data x2 entered. This shifts the image DP4 by x2, as shown in FIG. 4B. Conversely, as shown in FIG. 5A, an image DP5 may be moved to the left by y2 by feeding the copy sheet CS at such a timing that it follows the area DH by y2 based on shift data y2 entered, the resulting position of the image DP5 being shown in FIG. 5B.

The movement of an image stated above is practicable by controlling the scan timing and the sheet feed timing.

However, in a prior art copier, scanning depends on the size of a copy sheet, as previously stated. When a copy sheet is fed in such a manner as shown in, for example, FIG. 4B, scanning has to be wastefully performed by extra x2 after a latent image which is to be reproduced at the trailing end of the copy sheet CS has been formed, slowing down the copying operation.

Figure 2C:
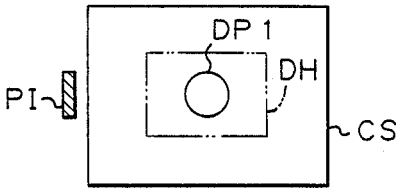
Figure 2D:
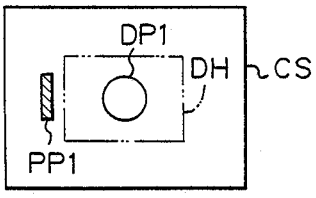
FIGS. 2D, 3D, 4D and 5D are schematic views illustrating a drawback particular to a prior art apparatus.
Figure 4C:
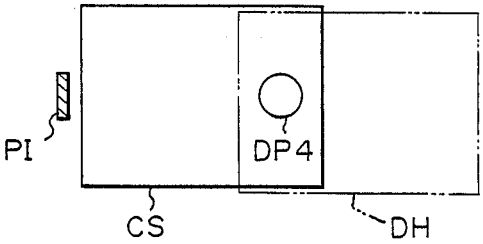
Figure 4D:
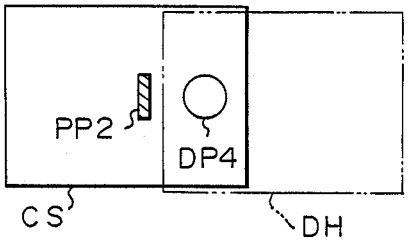

As stated earlier, in a prior art copier, a reference pattern located in a particular portion of a document reading surface is scanned to form its latent image on a photoconductive element. Specifically, assuming that the distance between the leading end of a document and the reference pattern is l and the ratio of magnification change is N, the latent image corresponding to the reference pattern is produced at a point which is ahead of the latent image corresponding to the leading end of the document by a distance of Nl. Hence, when the amount of shift is greater than Nl as represented by x1 in FIGS. 2A and 2B or by x2 in FIGS. 4A and 4B, an image PP1 or PP2 of the reference pattern is unwantedly recorded on the copy sheet CS as shown in FIG. 2D or 4D. This is because erasure for dissipating the charge in those areas which are not to be reproduced on the copy sheet and, therefore, for saving toner is performed on the basis of the size of a copy sheet. Conversely, in any of the image shift shown in FIGS. 3A and 3B and FIGS. 5A and 5B, the true latent image of the reference pattern is erased by the above-stated erasure resulting that a part of a document image which has nothing to do with the reference pattern is falsely recognized to be the image PIb or PId which corresponds to the reference pattern.

As discussed above, when the scan timing and the sheet feed timing of a prior art copier are controlled to shift an image to be recorded, the developer density control is disabled because a reference pattern is not formed or because the toner image of a reference pattern is unwantedly recorded on a copy sheet.

In accordance with the present invention, when a shift in the positive direction is commanded, the potential of a latent image of a document image begins to be formed at a point which is rearward of a transfer starting point by a specified amount of shift and ends at the transfer ending point. Hence, in the condition shown in FIG. 4B by way of example, that part of the latent image which extends from the trailing end of the copy sheet CS over x2, i.e, by needless latent image which does not appear on the copy sheet CS is not formed. This increases the recording speed corresponding. Especially, when a means for providing the potential of a latent image includes a means for optically scanning, or reading, a document, scanning a document area in which a latent image does not have to be formed is omitted to significantly speed up the recording operation.

Figure 3C:
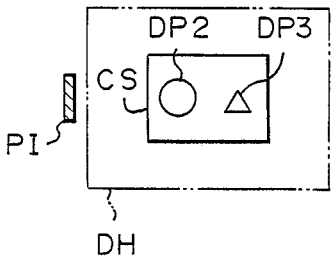
Figure 3D:
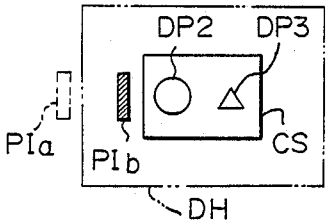

Further, assume that the shift in the positive direction implies causing the copy sheet CS shown in, for example, FIG. 2A or 4A to precede the area DH which corresponds to a document. Then, in accordance with the present invention, a toner image PI of a reference pattern is shifted to the positive side from the leading end of the area DH by an amount set (shift) plus x1, i.e., farther on the positive side than the leading end of an area which is to be transferred to the copy sheet CS, as shown in FIG. 2C or 4C. In such a condition, the toner image is not recorded on the copy sheet CS. On the other hand, assuming that a shift in a negative direction implies causing the copy sheet CS shown in, for example, FIG. 3A or 5A, to follow the area DH, the toner image PI of the reference pattern is shifted to the positive side from the leading end of the area DH by an amount set, as shown in FIG. 3C or 5C. Hence, even a recording apparatus capable of setting up any desired recording position on a recording medium is allowed to perform adequate developer density control by sensing the density of the toner image PI by an optical sensing means.

The words "positive" and "negative" mentioned above should be understood to merely refer to a relative direction. When such a relationship in direction is inverted, the positive shift, for example, will be such that the toner image of the reference pattern is provided downstream (i.e. on the positive side) of the trailing end of the area DH by an amount set plus the shift of x1.

The present invention will now be described in detail with reference to the accompanying drawings.

Figure 6:
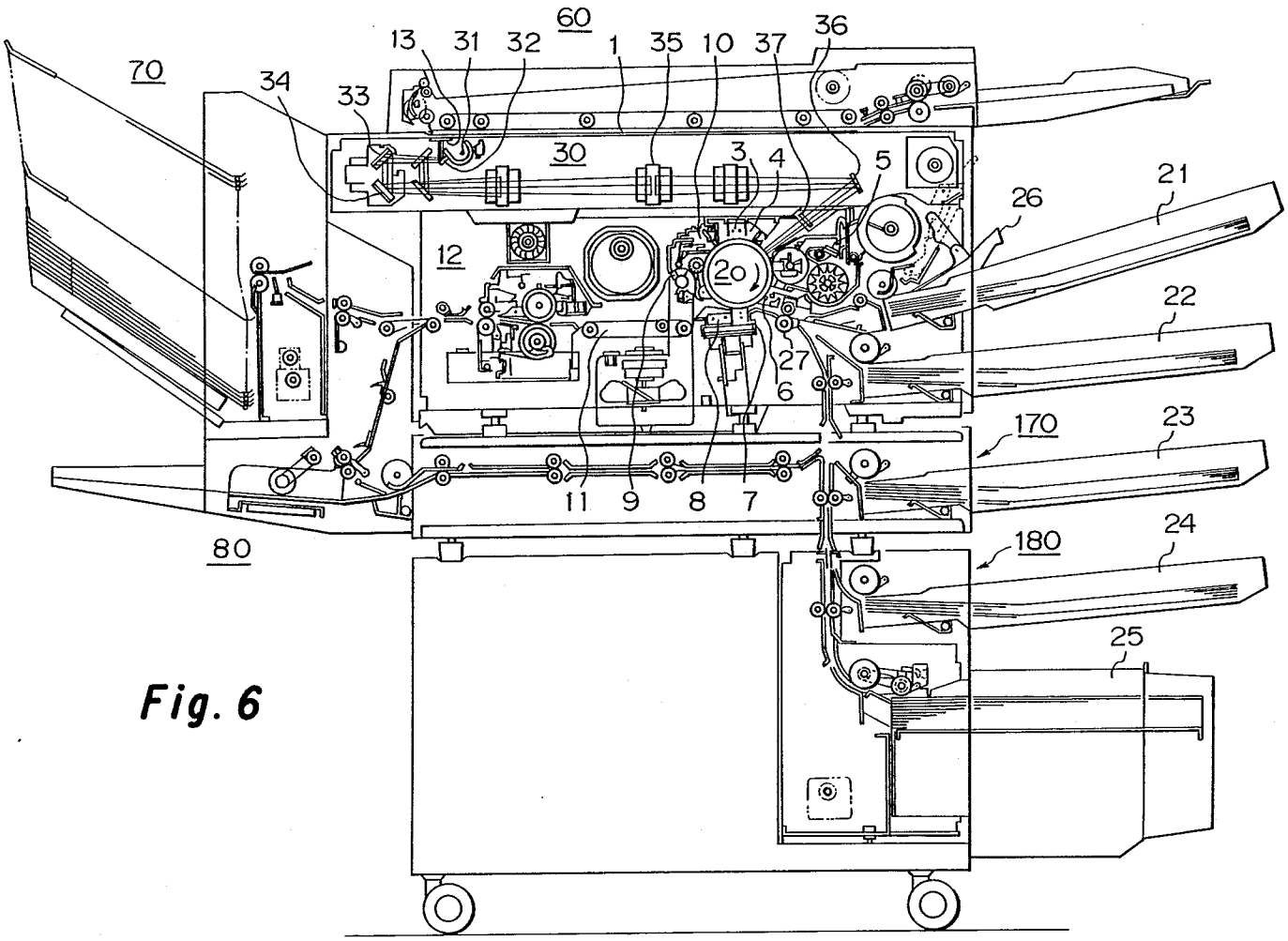
FIG. 6 is a section showing a copier in accordance with the present invention.

Referring to FIG. 6, a copier in accordance with the present invention is shown which is generally comprised of a copier body and various optional units such as an ADF 60, a sorter 70, an automatic two-side processing unit 80, and a sheet feed unit. Specifically, while a first and a second sheet systems are built in the copier body, a second sheet feed unit which constitutes a third sheet feed system and a third sheet feed unit which includes a fourth and fifth sheet feed systems are operatively connected to the copier body. The reference numerals 21, 22, 23 and 24 designate, respectively, sheet cassettes which are installed in the first, second, third and fourth sheet feed systems. The reference numeral 25 designates a tray which is included in the fifth sheet feed system.

A glass platen 1 to be loaded with a document is provided on the top of the copier body. As shown in detail in FIG. 1, a document in laid on the glass platen 1 with its left end (when seen from the back; hereinafter referred to as the leading end) aligned with the leading end (positioned slightly downstream of the left end of the glass platen 1 with respect to the subscanning direction for implementing size indication) of a document setting area of the glass platen 1. At the same time, the center of that side of the document which is aligned with the leading end of the glass platen 1 is brought into register with with a mark Δ. In this particular embodiment, it is possible to copy an A3 document at maximum by orienting its lengthwise direction horizontally (A3 vertical feed; represented by A3R in FIG. 1) in which case a document is set as indicated by a dashed line. When it is desired to copy an A4 document with its lengthwise direction oriented horizontally (A4 vertical feed; represented by A4R in FIG. 1), it is positioned as indicated by a dash-and-dots line.

An optical scanning system 30 is positioned below the glass platen 1. The scanning system 30 includes a lamp 31, a first mirror 32, a second mirror 33, a third mirror 34, a lens 35, a fourth mirror 36, and a slit 37. A first carriage loaded with the lamp 31 and first mirror 32 and a second carriage loaded with the second and third mirrors 33 and 34, respectively, are mechanically driven at a relative speed of 2:1, so that the length of the optical path may not be changed during scanning. This scanning direction, i.e., subscanning direction is the left-right direction as seen in FIG. 6, and the position at which the system 30 starts subscanning is defined at the left end. At the subscanning start position, a home position sensor, not shown, senses the second carriage to be turned on.

Figure 10:
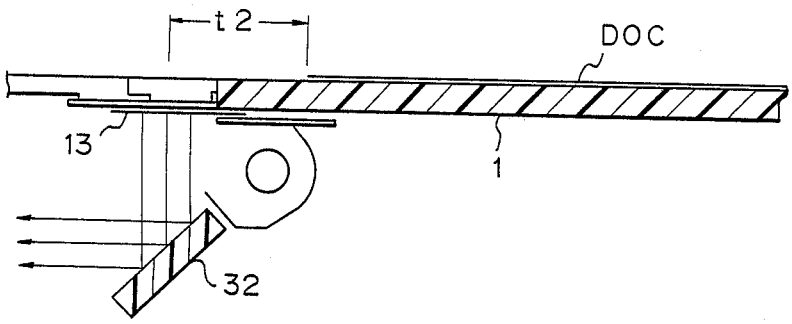
FIG. 10 is a fragmentary section showing a scanning start position and its neighborhood of the copier as shown in FIG. 6.

Located at an image read position of the subscanning start positions is a reference density pattern, or P sensor pattern as hereinafter referred to, 13. Specifically, as shown in FIG. 10, the image read position of the subscanning start position is defined at the left of the leading end of a document DOC on the glass platen 1 and at a distance of t2 from the latter. The P sensor pattern 13 is provided on a surface which is contiguous with the underside of the glass platen 1, such that it is read at the above-mentioned particular position. The P sensor pattern 13 is implemented with a sheet provided with a black pattern which has predetermined reflectivity. The lens 35 is a zoom lens and driven by a motor to change magnification. Light issuing from the lamp 31 is reflected by the document reading surface, i.e., P sensor pattern 13 or the document DOC to reach a photoconductive drum 2 by way of the first, second and third mirrors 32, 33 and 34, respectively, the lens 35, the fourth mirror 36, and the slit 37. Arranged around the photoconductive drum 2 are a main charger 3, an eraser 4, a developing cartridge 5, a toner image sensor, or P sensor as hereinafter referred to, 6, a transfer charger 7, a separation charger 8, a cleaning unit 9, and others.

A copying process will be briefly described.

While the surface of the drum 2 is uniformly charged to a predetermined high potential by the main charger 3, the charge deposited in those areas of the drum surface which are not used for copying is erased by the eraser 4, as will be described in detail later. When the charged surface of the drum 2 is illuminated by the reflection from the document DOC, the potential thereon is changed (discharged by illumination) based on the intensity of light. The drum 2 is rotated as indicated by an arrow in FIG. 6 while, in synchronism therewith, the scanning system 30 sequentially scans the document. Consequently, a potential distribution, i.e., an electrostatic latent image corresponding to the density (reflectively) distribution of a document image is developed on the drum surface. As that part of the drum surface in which the latent image is provided moves past the developing cartridge 5, toner in the cartridge 5 is electrostatically transferred to the surface of the drum 2 based on the potential distribution. As a result, a toner image corresponding to the latent image is produced on the drum 2 (development).

As the copying process proceeds, a copy sheet is fed from any one of the five sheet feed systems selected. The copy sheet is driven by a register roller 27 such that it lies on the drum 2 at a predetermined timing. Then, the transfer charger 7 transfers the toner image from the drum 2 to the copy sheet and, then, the separation charger 8 separates the copy sheet from the drum 2. Subsequently, the copy sheet is advances to a fixing unit 12 by a belt 11 so that the toner image is fixed on the copy sheet by heat which is generated in the fixing unit 12. The sheet coming out of the unit 12 is discharged to the sorter 70 or the automatic two-side processing unit 80 through a predetermined discharge path.

In this particular embodiment, the axial length (direction perpendicular to the sheet surface of FIG. 6; main scanning direction) of the drum 2, i.e., the maximum recording width available is substantially equal to the length of shorter sides of format A3. Therefore, when the length of a copy sheet as measured in the main scanning direction is shorter than the length of shorter sides of format A3, e.g., when an A4 copy sheet is fed with its lengthwise direction parallel to the sheet feed direction (vertical feed), toner is deposited on those areas of the drum 2 which are not to be transferred to a copy sheet, due to a charge remaining thereon. This results in wasteful toner consumption while increasing the cleaning load. In the light of this, the eraser 4 located upstream of the cartridge 5 dissipates the charge in those areas of the drum 2 by illumination (side erasure).

The copier of this embodiment has editing capabilities, i.e., a capability of extracting a particular area of a document image as specified and a capability of erasing that particular area. The eraser 4 is adapted to expel the charge deposited on the drum 2 other than its area in which a latent image corresponding to the document image of the specified area is to be formed, or the charge deposited in that area. As regards the toner image of the P sensor pattern 13, the latent image is formed in that area of the drum 2 which is not to be transferred to a copy sheet, and the charge deposited in that area is not dissipated. The area for forming the latent image of the P sensor pattern 13 has the same length as the shorter sides of format A5 in the main scanning direction with respect to the center of the axial dimension of the drum 5, the width (length in the subscanning direction) of that area being about 20 millimeters.

Figure 12A:
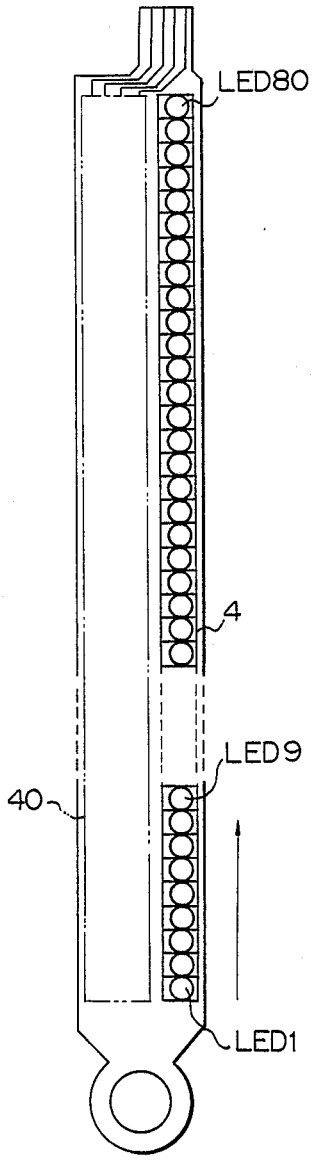
FIG. 12A is a front view of an eraser.

Referring to FIG. 12, the eraser 4 is shown in detail. While the main scanning direction is represented by Y in FIG. 12, the upper portion of the eraser 4 corresponds to the axially inner portion of the drum 2 looking into the copier as shown in FIG. 6. As shown in FIG. 12, the eraser 4 has a rod-like configuration and comprises an array of eighty light emitting diodes LED1 to LED80 which are arranged at intervals of 4 millimeters. The light emitting diodes are energized and deenergized by an eraser driver 40 independently of each other, whereby the area of the drum 2 located just below the eraser 4 is discharged by illumination on a 4-millimeter basis. For example, in the case of A4 vertical feed, the previously stated side erase is effected by energizing the LED1 to LED14 and LED 67 to LED80. On the other hand, as regards the toner image of the P sensor pattern 13, side erasure associated with A5 vertical feed (A5R) is executed in which when that area of the drum in which a latent image corresponding to the pattern has reached a position just below the eraser 4, the LED1 to LED 22 and LED 59 to LED80 are energized. Constructed integrally with the eraser driver 40, the eraser 4 may be mounted in and dismounted from the copier body by holding an annular handle (lower end) of the eraser 4.

Figure 7A:
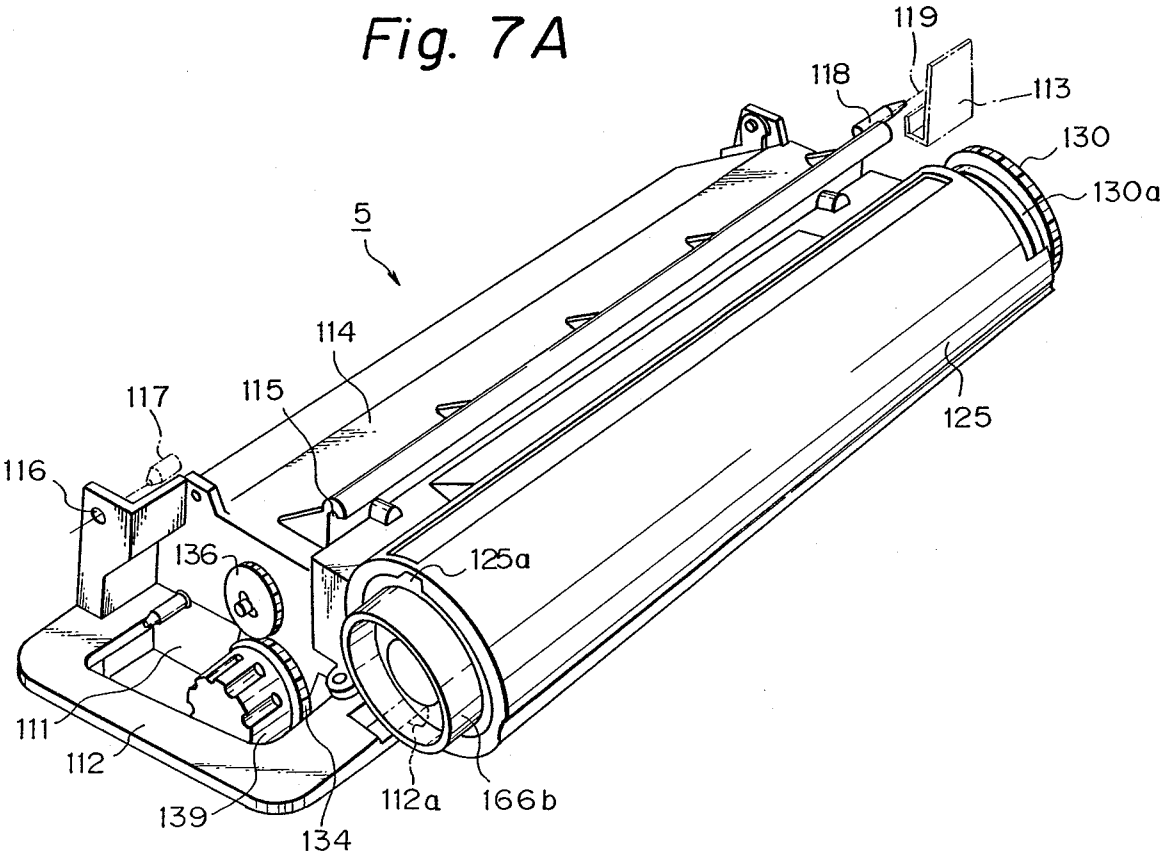
FIGS. 7A and 7B are respectively a perspective view and a section showing a developing cartridge.

Referring to FIGS. 7A to 7H, a specific construction of the developing cartridge 5 is shown. As shown in FIG. 7A, the cartridge 5 includes a casing end wall 111 which is provided with a generally U-shaped handle 112. The cartridge 5 may be mounted in the copier body by inserting it along the axis of the drum 2 and toward the inner end of the drum 2 as viewed in FIG. 6. The handle 112 is adopted to facilitate such an operation. While the copier body is provided with a guide rail 113 which extends in the axial direction of the drum 2, an upper casing 114 of the cartridge 5 is provided with a guide channel 115 which faces downward. By sliding the cartridge 5 with the guide channel 115 mated with the guide rail 113, accurate regulation of the moving direction of the cartridge 5 is insured. The cartridge 5 is positioned relative to the drum 2 by mating an aperture 116 formed though the cartridge casing with a pin 117 which is rigid on the copier body, and mating the inner end 118 of a developing sleeve support shaft, which will be described, with an aperture 119 of the copier body. After the cartridge 5 has been positioned so, a hook 112*a* provided in a base portion of the handle 112 is coupled with a lug of the copier body to thereby firmly fix the cartridge 5 in position.

Figure 7B:
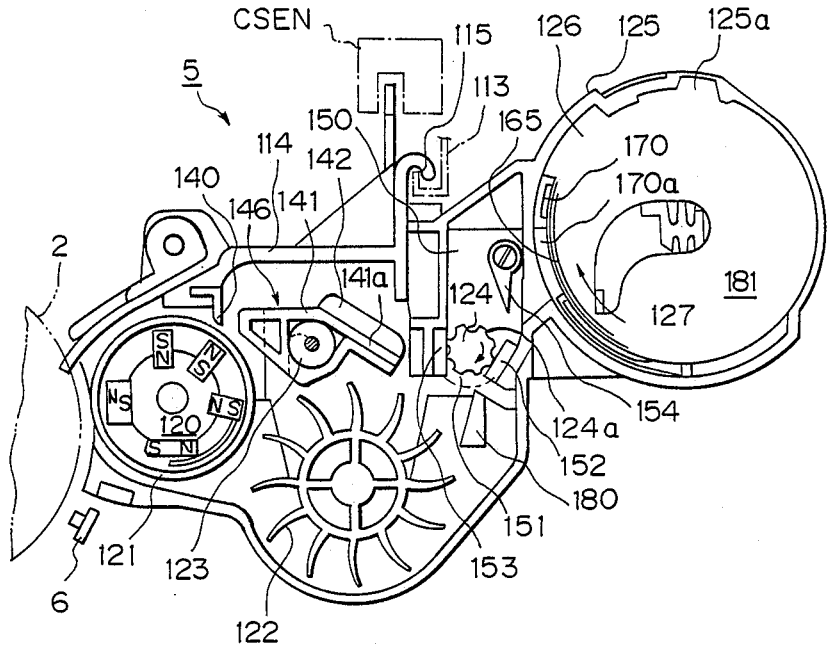
Figure 7C:
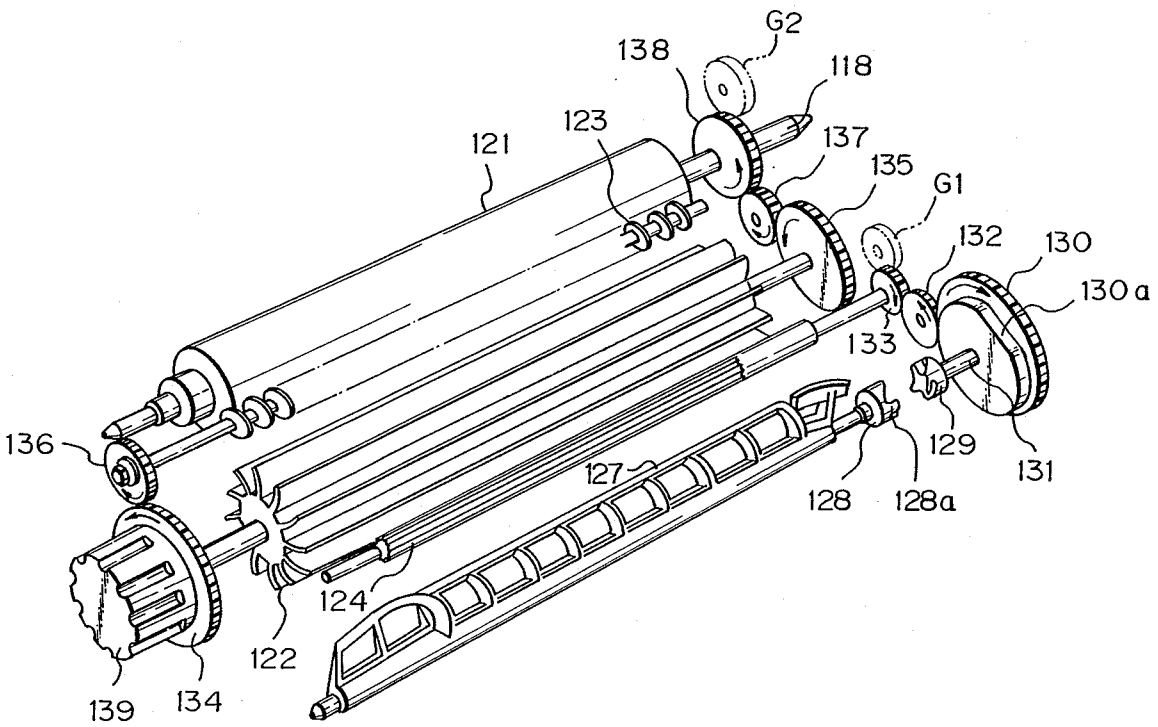
FIGS. 7C, 7E, 7F and 7H are perspective views showing, respectively, a drive system, a developer transport unit, a toner cartridge and a shutter plate which are installed in the developing cartridge of FIG. 7A.

FIG. 7B shows the developing cartridge 5 of FIG. 6 in an enlarged scale. As shown, opposite end walls of the cartridge 5 support a non-magnetic developing sleeve 121 having a group of stationary magnets 120 thereinside, a paddle wheel 122 for agitating a developer, a developer transport screw 123, and a toner supply rod 124 provided with a plurality of parallel axially extending grooves 124 thereon. Each of these elements 121, 122, 123 and 124 is rotatable. A hollow cylindrical casing 125 is provided in a shoulder portion of the cartridge 5 for storing a cylindrical toner cartridge 126 therein. A toner supply bar 127 is rotatably supported by opposite end walls of the toner cartridge 126 and substantially at the center of the latter. The inner end of the toner supply bar 127 as viewed in FIG. 7B protrudes from the end wall of the toner cartridge 126. As shown in FIG. 7C, a coupling member 128 is rigidly mounted on that end of the toner supply bar 127 which protrudes from the toner cartridge 126 as stated. Having a saw-toothed piece 128*a*, the coupling member 128 mates with a coupling member 129 of the developing cartridge 5 to become integral therewith with respect to rotation, when the toner cartridge 126 is mounted in the developing cartridge 5. The coupling member 129 is mounted on the inner end of a shaft 131 of a gear 130 which is mounted on the casing outer periphery of the developing cartridge 5. The gear 130 is operatively connected via an intermediate gear 132 to a gear 133 which is mounted on the end of the toner supply bar 124.

Gears 134 and 135 are mounted on opposite ends of the shaft of the paddle wheel 122. The gear 134 is meshed with a gear 136 which is mounted on one end of the screw 123, and the gear 135 is meshed with a gear 138 which is mounted on the end of the shaft of the developing sleeve 121 through an intermediate gear 137. The gear 134 is provided with a knob 139 for manually rotating the paddle wheel 122. Those gears are arranged on the outer surface of the casing end wall of the developing cartridge 5. When the developing cartridge 5 is mounted in the copier body, the gears 133 and 138 are brought into mesh with, respectively, drive gears G1 and G2 which are mounted on the copier body. In this condition, the gears 130 and 132 to 138 are individually rotated as indicated by arrows in FIG. 7C.

Figure 7D:
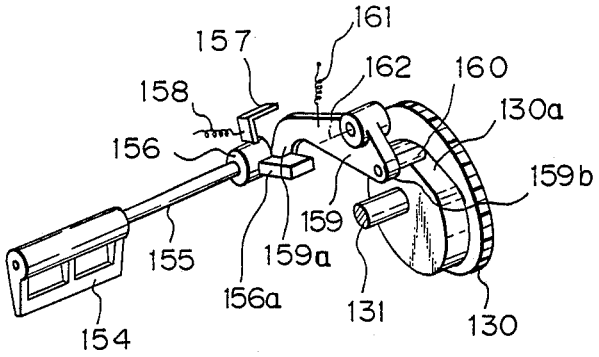
FIG. 7D is a fragmentary perspective view showing the drive system of FIG. 7C.
Figure 7E:
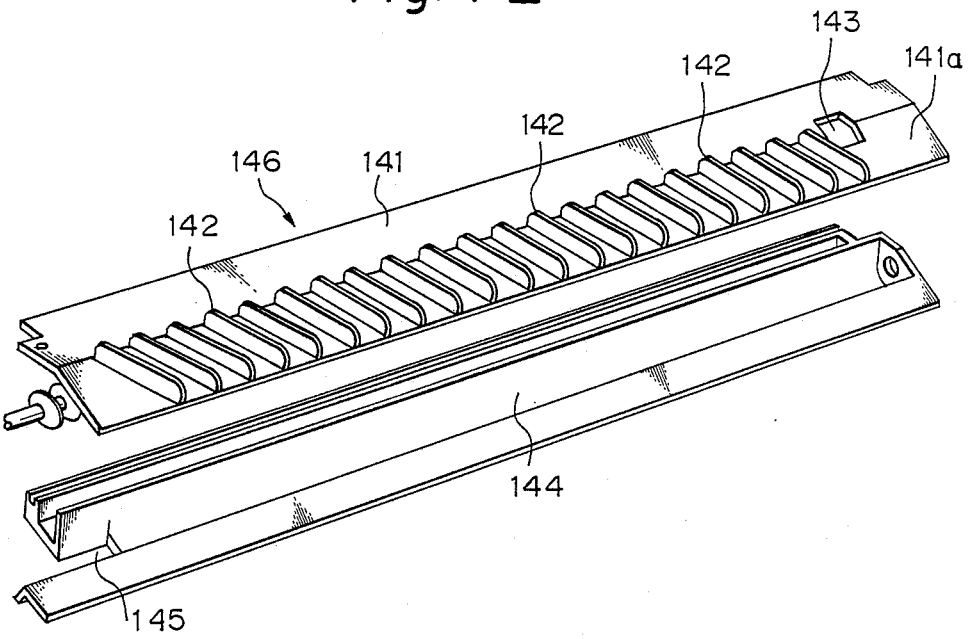

In FIG. 7B, the magnetic brush formed on the developing sleeve 121 is regulated to a predetermined thickness by a blade 140 which is fixed to the developing cartridge casing 114. An excessive part of the developer, i.e., magnetic carrier with toner deposited thereon scraped off by the blade 140 is moved on and along a plate 141 to the right as viewed in the figure and, then, slid along a slope 141a which has a number of fins 142 thereon, as shown in FIG. 7E. The developer flowing down along the slope 141 is dropped on the paddle wheel 122. The developer positioned at one end portion of the plate 141 is dropped through an opening 143 of the plate 141 onto one end portion of the transport screw 123 to be thereby transported to the other end of the transport screw 123 and, then, returned to one end portion of the paddle wheel 122 through an outlet 145 which is formed through the end of a tray 144. A developer transport unit 146 which is constituted by the plate 141 and tray 144 and accommodates the transport screw 123 therein is fixed to the casing of the developing cartridge 5 at opposite ends thereof and positioned above the developing sleeve 121 and paddle wheel 122.

In FIG. 7B, the toner supply rod 124 is so located as to stop an opening 151 which is formed through the bottom of a hopper 150. Elongate elastic members 152 and 153 are provided on opposite inner surfaces of the hopper 150 which define the opening 151, the elastic members 152 and 153 each making contact with the periphery of the toner supply rod 124. The elastic members 152 and 153 are made of synthetic resins. A feeler 154 is disposed in an upper portion of the upper 150 and cantilevered to one end wall of the hopper 150. As shown in FIG. 7D, the feeler 154 has a shaft 155 while a boss 156 of an arm 156*a* is rigidly mounted on the outer end of the shaft 155. The feeler 154 is constantly biased by a relatively weak spring 158 so that the arm 156a is lightly pressed against one end 159*a* of a lever 159 from below. A pin 160 is studded on the other end 159*b* of the lever 159. The pin 160 is pressed against a cam 130*a* which is integral with the gear 130, by a spring 161 which acts on the lever 159. The lever 159 is supported by the outer surface of the casing end wall of the developing cartridge 5 through a rod 162.

Figure 7F:
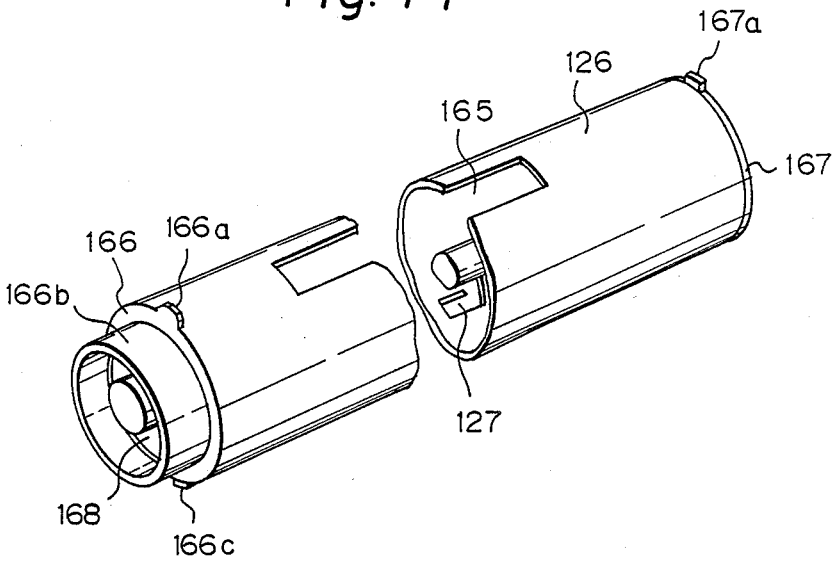
Figure 7G:
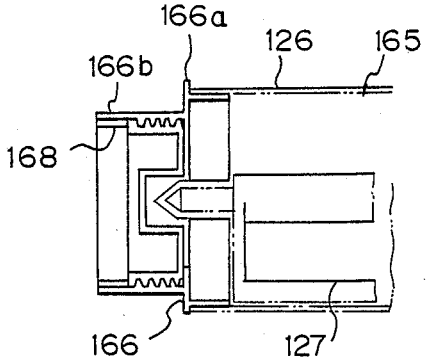
FIG. 7G is a section showing one end portion of the toner cartridge.
Figure 7H:
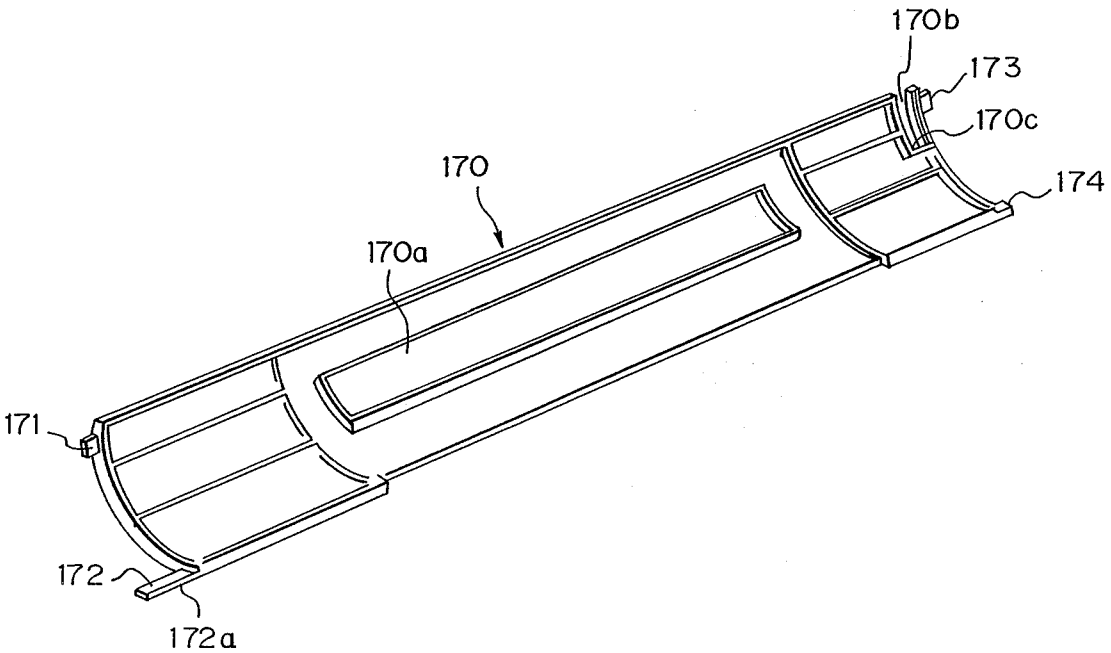

As shown in FIG. 7F, the cylindrical wall of the toner cartridge 126 is provided with a toner supply opening 165. One end wall 166 of the toner cartridge 126 is provided with radially outwardly extending lugs 166*a* and 166*c*, and the other end wall 167 is provided with a radially extending lug 167*a*. A cylindrical grip 166*b* is formed integrally with the end wall 166. A cylindrical lid 168 is threaded into the grip 166*b*. The toner cartridge 126 is inserted into the casing 125 with the lug 167*a* mated with a groove 125*a*. FIG. 7A, which is formed on the inner peripheral wall of the cartridge casing 125. Then, after the lug 166*a* has been fully received in the groove 125*a*, the cartridge 126 is rotated counterclockwise as viewed in FIG. 7B to cause the toner supply opening 165 of the cartridge 125 into communication with a top opening of the hopper 150 through an opening 170*a* of a shutter plate 170, as described in detail later. In this condition, the lugs 166*a* and 167*a* received in the groove 125 are movable in and along a circumferential groove of the casing 125 which is contiguous with the groove 125*a*. The shutter plate 170 is implemented with a molding of plastics and provided with ribs for reinforcement on its inner surface. A shown in FIG. 7H, lugs 71 to 74 extend from the opposite corner portions of the shutter plate 170 in the lengthwise direction of the latter. The lugs 71 to 74 are loosely fitted in arcuate grooves, not shown, which are formed on opposite inner surfaces of the casing 125, whereby the shutter plate 170 is supported in such a manner as to be rotatable along the inner wall of the casing 121 and between a position where the opening 170*a* of the shutter plate 170 closes the top opening of the hopper and a position where the former opens the latter.

As the toner cartridge 126 is inserted in the casing 125, the lug 167*a* of the cartridge 126 faces the opening of a recess 170*b* of the shutter plate 170 while, at the same time, the lug 166*c* faces the right edge 172*a* of the lug 172. In this condition, when the toner cartridge 126 is rotated counterclockwise as viewed in FIG. 7B with its grip 166 held, the lug 167*a* is caused to abut against the bottom 170*c* of the recess 170*b* of the shutter plate 170. Then, the opening 165 of the cartridge 126 and the opening 170*a* of the shutter plate 170 are brought into alignment and, as the cartridge 126 is further rotated, the opening 170*a* of the shutter plate 170 is finally caused into alignment with the top opening of the hopper 150. To remove the toner cartridge 126 from the casing 125, the toner cartridge 126 is rotated clockwise from the position of FIG. 7B so that the lug 166*c* of the cartridge 126 urges the edge 172*a* of the lug 172 to thereby rotate the shutter plate 170, whereby the top opening of the hopper 150 is closed. The cartridge 126 is rotated until the lugs 166*a* and 167*a* align with the groove 125*a* of the casing 125 and, in this position, it is pulled out in the axial direction. Hence, while the toner cartridge 126 is removed from the casing 125, the shutter plate 170 constantly closes the opening of the hopper 150.

Figure 8:
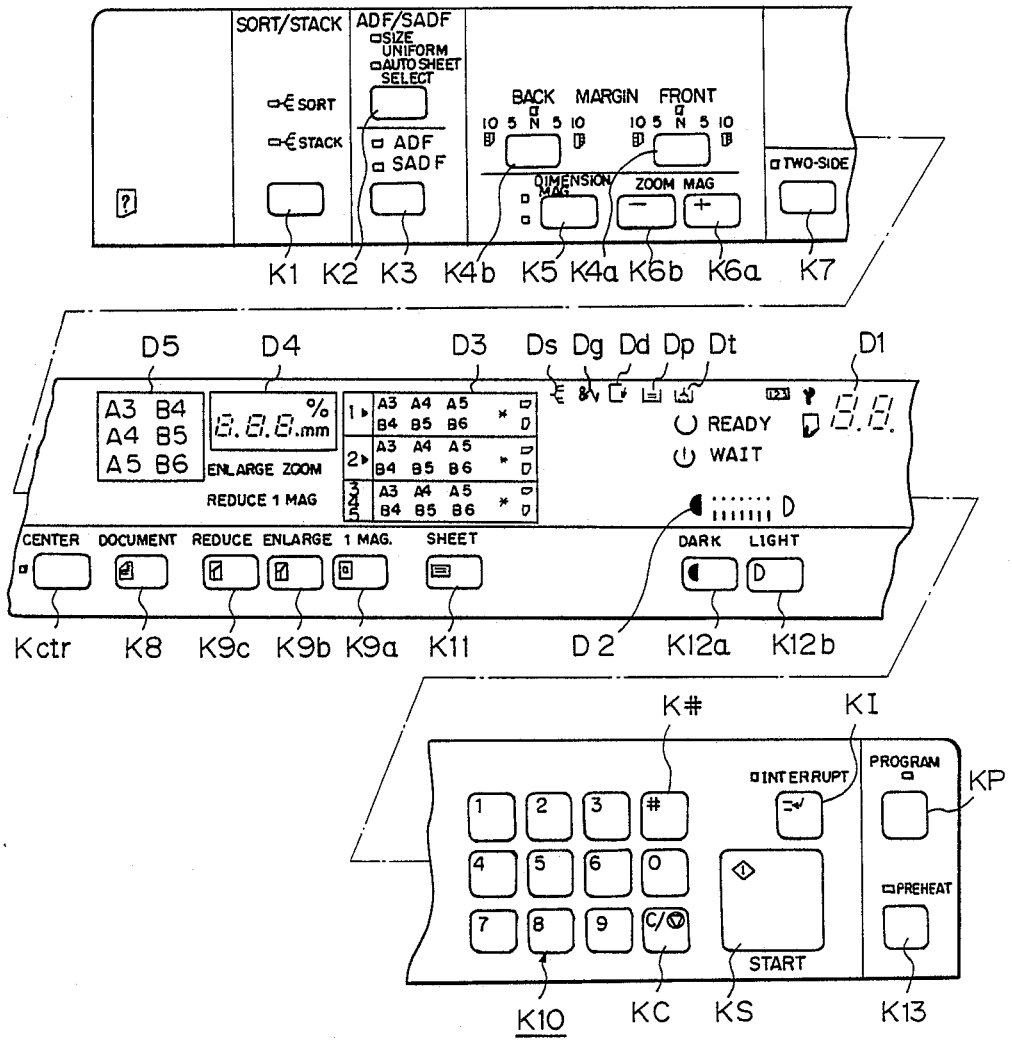
FIG. 8 is a plan view showing an operation board which is included in the copier of FIG. 6.

Referring to FIG. 8, there is shown an operation board which is provided on the top of the copier body. As shown, the operation board is furnished with numerous key switches K1, K2, K3, K4*a*, K4*b*, K5, K6*a*, K6*b*, K7, Kctr, K8, K9*a*, K9*b*, K13, KC, KS, K#, KI, and KP, numerous indicators D1, D2, D3, D4, D5, Ds, Dg, Dd, Dp and Dt, and others.

Major ones of the various key switches provided on the operation board will be briefly described.

The key switch K1 is adapted to selectively designate a fixed mode (sorter not used), a sort mode and a stack mode which are available with the sorter 70. The key switch K3 is operable to select one of a manual document set mode, an ADF mode and an SADF mode which are available with the ADF 60. The key switches K4*a* K4*b* are adapted to specify a margin of each of the front and back surfaces in a two-side copy mode. The key switches K6*a*, K6*b*, K9*a*, K9*b* and K9*c* are usable to enter a desired magnification. The key switch K7 is adapted to select the two-side copy mode. The key switch Kctr is available for selecting a centering mode. The key switches K9*a*, K9*b* and K9*c* are each used to enter a document size, and the key switch K11 is used to designate one of the sheet feed systems. The key switch K10 is representative of numeral keys, or ten keys, for entering a desired number of copies. The key switches K12*a* and K12*b* are adapted to set up desired copy density. The key switch KC is a clear/stop key which is usable to clear the copy number entered on the key switch K10 and to stop a copying operation. Further, the key switch KS is a print start key.

Major ones of the indicators, or displays, also provided on the operation board are as follows.

The display DI is a two-bit seven-segment numerical display which in an ordinary mode displays the number of copies set while the copier is in a stand-by condition and the number of copies produced while the copier is in operation. The indicator D2 is adapted to show copy density selected. The indicator D3 is a display for showing the sizes and orientations of copy sheets loaded in the individual sheet feed systems, and the sheet feed system selected. The indicator D4 is a three-bit seven-segment numerical display which in an ordinary operation mode displays a ratio of magnification change on a 1 % basis. The indicator D5 is adapted to show a document size specified. The indicators Ds, Dg, Dd, Dp and Dt function to indicate sorter failure, sheet feed failure, cover open condition, no sheet condition, and no toner condition, respectively.

Figure 9:
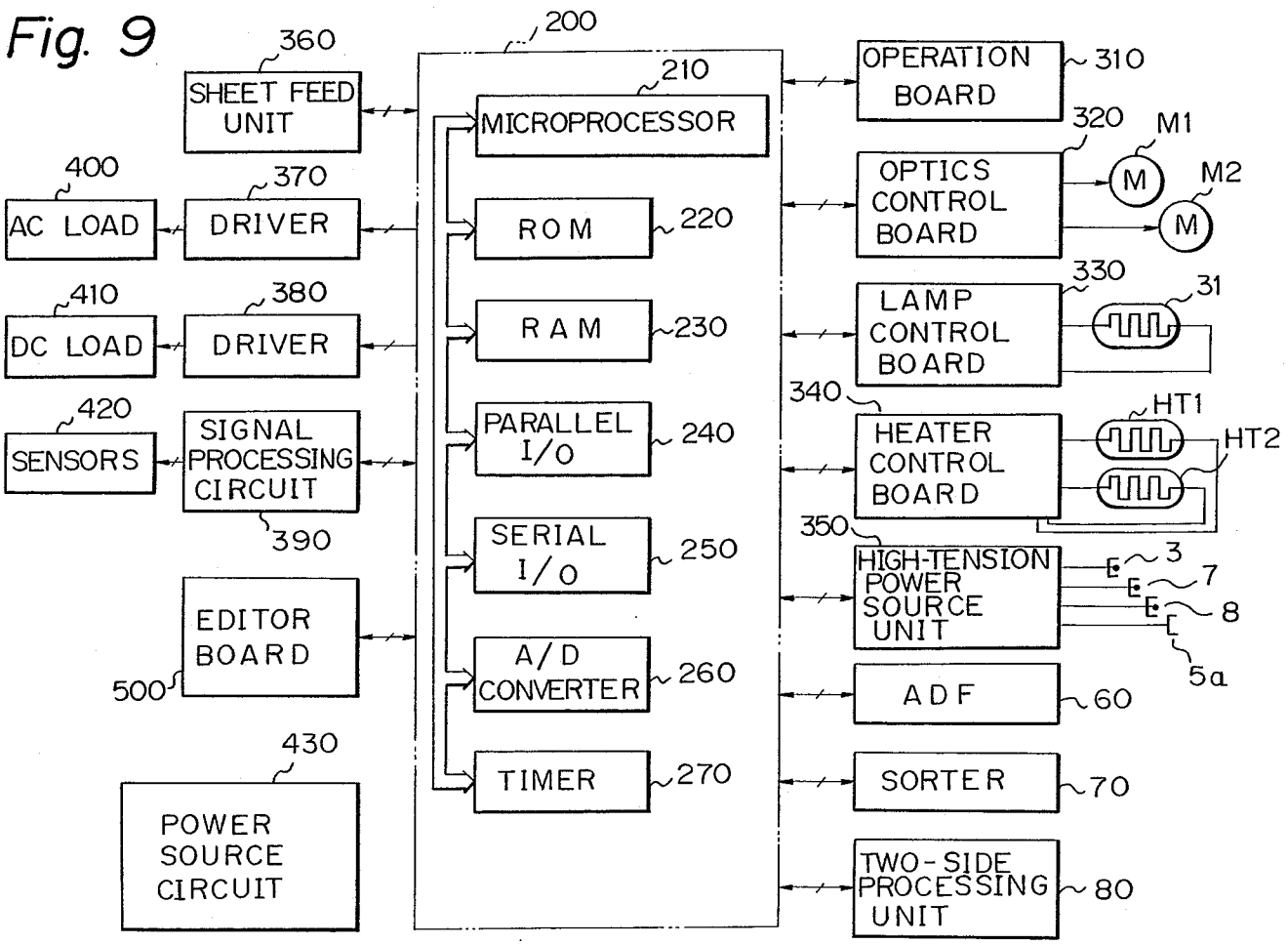
FIG. 9 is a schematic block diagram showing an electrical circuit arrangement built in the copier of FIG. 6.

Referring to FIG. 9, an electric circuit arrangement built in the copier of FIG. 6 is schematically shown. As shown, a main control board 200 includes a microprocessor 210, a read only memory (ROM) 220, a random access memory (RAM) 230, a parallel I/O port 240, a serial I/O port 250, an analog-to-digital (A/D) converter 260, and a timer 270. Connected to the main control board 200 are the operation board (see FIG. 8), an optics control board 320, a lamp control board 330, a heater control board 340, a high-tension power source unit 350, the ADF 60, the sorter 70, the two-side processing unit 80, a sheet feed unit 360, drivers 370 and 380, a signal processing circuit 390, and an editor board 500. A power source circuit 430 is adapted to feed a predetermined constant voltage to each of various structural elements.

The optics control board 320 functions to control an electric motor M1 for driving the optical scanning system 30, and an electric motor M2 for adjusting the magnification which is set up by the zoom lens. The lamp control board 330 serves to control the amount of light issuing from the lamp 31. The heater control board 340 serves to control the temperature of a fixing heater HT1 which is installed in the fixing unit 12, and that of a drum heater HT2 built in the drum 2. The high-tension power source unit 350 generates a high-tension voltage to be applied to each of the main charger, a bias electrode 5a of the developing cartridge 5, the transfer charger 7, and the separation charger 8. While various AC loads (400) are connected to the driver 370, various DC loads (410) are connected to the driver 380. Connected to the signal processing circuit 390 are various sensors (420). The AC loads 400 may be represented by a main motor for driving the drum 2 and the like, a motor associated with the developing cartridge 5, a fan motor for transport, and a fan motor for cooling. The DC loads 410 may be represented by a solenoid for control cleaning, a clutch for controlling the register roller, a solenoid for controlling a separator pawl, the eraser 4, a total counter, a solenoid for controlling toner supply, and a solenoid for controlling oil supply.

Figure 12B:
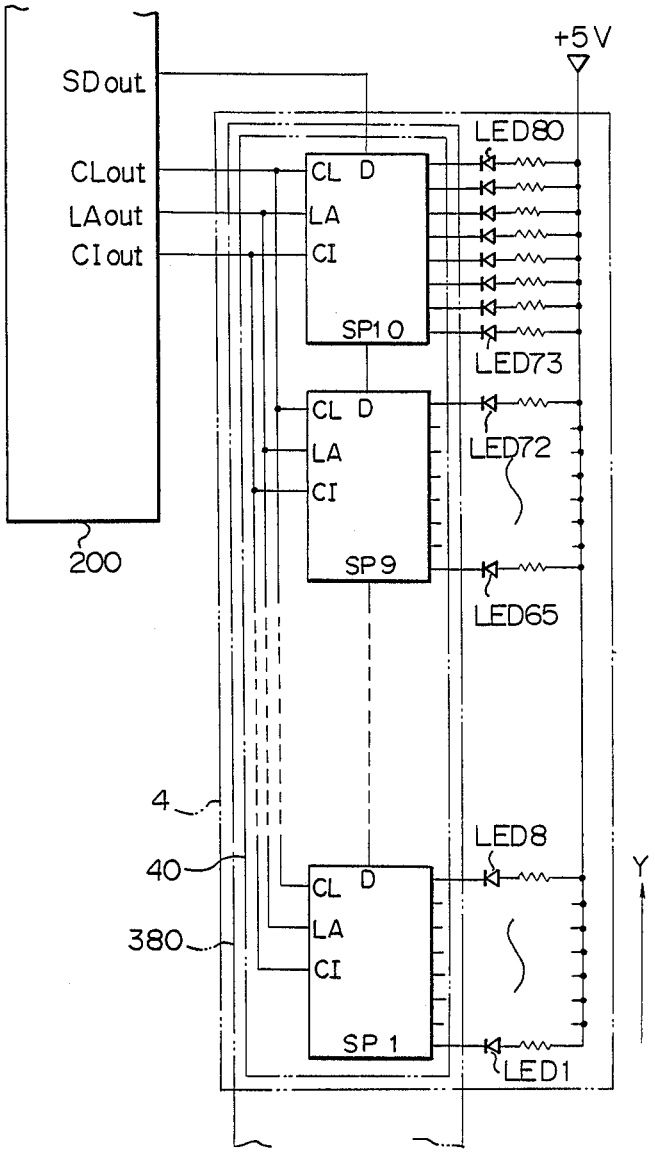
FIG. 12B is a schematic circuit diagram showing the eraser of FIG. 12A.

FIG. 12B shows a specific circuit arrangement of the eraser 4. As previously stated with reference to FIG. 12A, the eraser 4 is constituted by an array of eighty light emitting diodes LED1 to LED80 which are arranged at intervals of 4 millimeters. The anodes of LED1 to LED80 are connected to a power source line (+5 volts) each through a resistor while cathodes thereof are connected to parallel output terminals of ten serial-in/parallel-out (S/P) shift registers SP1 to SP10 which constitute the eraser driver 40. The S/P registers SP1 to SP10 are connected in series in this order with the S/P register SP10 located on the upstream side. The serial input terminal D of the S/P register SP10 is connected to the output terminal of the serial I/O port 250 of the main control board 200 via a serial output port SDout of the main control board 200. Erase data for erasing that part of the drum 2 which is located just below the eraser 4 in synchronism with subscanning are sequentially delivered from a serial output port SDout of the main control board 200, data corresponding to LED1 first. The clock input terminals CL of the S/P registers SP1 to SP10 are connected to a data set clock output port CLout of the main control board 200 in parallel with each other, the latch input terminals LA to a latch signal output port LAout of the main control board 200, and the clock inhibit input terminals CI to a clock inhibit output port CIout of the main control board 200.

In operation, when a high or H level (inhibit cancel) is delivered from the clock inhibit output port CIout of the main control board 200 in synchronous with subscanning, erase data output from the serial output port SDout timed to a data set clock which is fed from the data set clock output port CLout are sequentially shifted from the bits of the S/P register 10 toward those of the S/P register SP1. As an erase timing is reached with the S/P registers SP 1 to SP10 loaded with the erase data, a latch signal appears on the latch signal output port LAout of the main control board 200 so that the erase data are fed out in parallel. At this instant, those bit output terminals of the S/P registers SP1 to SP10 with erasure produce an L level while those bit output terminals without erasure produce an H level. Hence, only those of the light emitting diodes LED1 to LED80 with erasure are energised.

In the above construction, the S/P registers SP1 to SP10 loaded with erase data hold those data until updated and repeats the output of the same erase data every time a latch signal appears. This is to reduce the frequency of erase data setting and, thereby, the load acting on the main control board 200.

The various sensors 420 may be represented by a timing pulse generator which generates pulses timed to the rotation of the main motor, the P sensor 6, a home position sensor responsive to the home position of the scanning system 30, a register sensor located in the vicinity of the register roller 27 for sensing a copy sheet, and sheet sensors and sheet presence/absence sensors which are disposed in the individual sheet feed systems.

Figure 11:
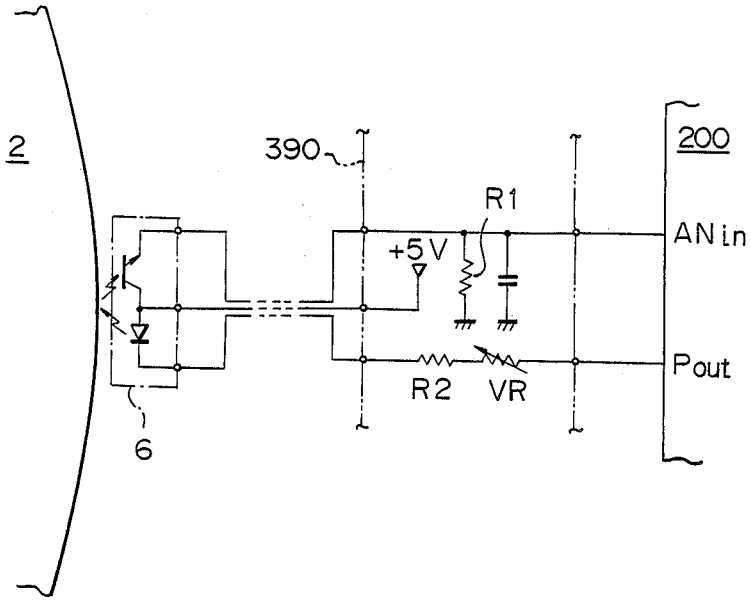
FIG. 11 is a schematic circuit diagram showing a toner image sensor.

A specific circuit arrangement of the P sensor 6 is shown in FIG. 11. As shown, the P sensor 6 is made up of a light emitting diode and a phototransistor. The light emitting diode has an anode which is connected to the power source line (+5 volts), and a cathode which is connected to the output port Pout of the main control board 200 via a resistor R2 and a variable resistor VR. In this configuration, the light emitting diode of the sensor 6 is energized and deenergized by the output of the port Pout. The emitter, or output terminal, of the phototransistor is connected to the input terminal of the A/D converter 260, which is built in the main control board 200, via an analog input port ANin of the main control board 200. When a predetermined P sensor read timing is reached, an L level appears on the output port Pout of the main control board 200 to energize the light emitting diode. Then, the output of the phototransistor to which the reflection is incident is read out via the analog input port ANin. Specifically, if the time when the P sensor 6 faces the P sensor pattern toner image is selected to be the P sensor read timing, the output of the phototransistor read through the analog input port ANin corresponds to the density (toner density) of the P sensor pattern toner image.

Figure 13A:
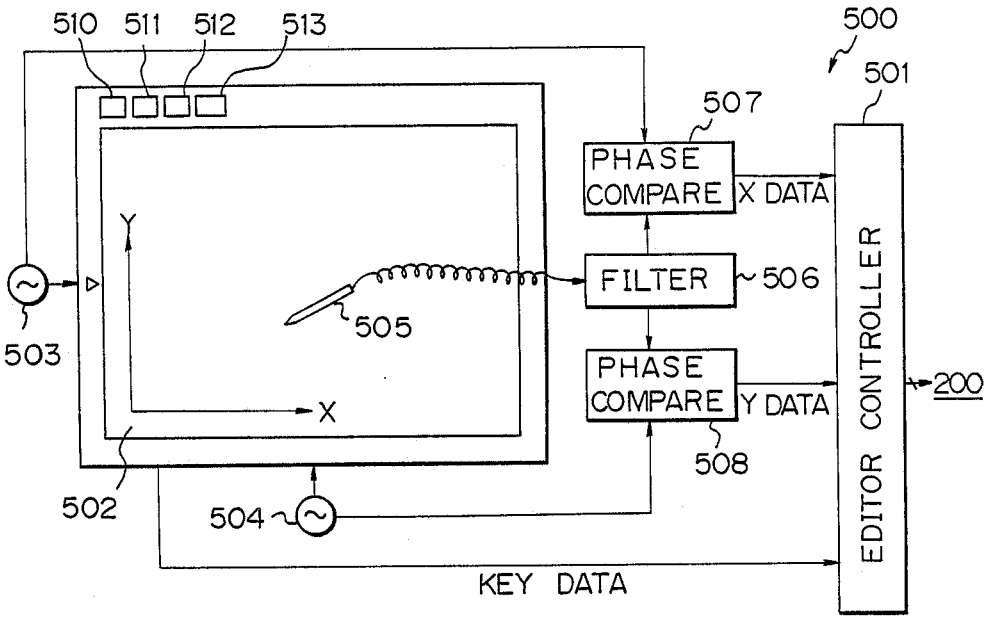
FIG. 13A is a schematic block diagram showing an editor.

Referring to FIG. 13A, the editor board 500 is schematically shown in a block diagram. Implemented with an electrostatic coupling type coordinates reader which uses a resistance phase shift circuit, the editor board 500 includes an electrically insulated board 502 which is provided with X and Y electrodes in a lattice configuration on the back thereof, although not shown in the figure. The X and Y electrodes are shaped flat and insulated from each other. Specifically, the X electrodes are constituted by a group of numerous linear electrodes which individually extend along the Y axis (corresponding to the main scanning direction), and the Y electrodes are constituted by a group of numerous linear electrodes which individually extend along the Y axis (corresponding to the subscanning direction). The X and Y electrode groups are connected to, respectively, phase shifters 503 and 504 which are each driven by a signal having a different frequency. The reference numeral 505 designates a light pen having high impedance. A signal output by a contactor which is disposed at the tip of the pen is picked up through the capacitance between the X and Y electrodes and the tip of the pen. This signal is passed through a filter 506 to be separated into an X signal (output of the phase shifter 503) and a Y signal (output of the phase shifter 504). The X and Y signals are subjected to phase comparison at phase comparators 507 and 508, respectively. Finally, X and Y data (electric signals) produced by relating amounts of phase shift to the XY coordinates of the tip of the pen are obtained.

The editor board 500 is provided with a key switch 510 operable to enter a signal for using the board 500, a key switch 511 for use in a partial extract mode, a key switch 512 for use in a partial erase mode, and a key switch 513 for use in a shift mode. The X and Y data and the key operation data are fed to an editor controller 501.

Figure 1:
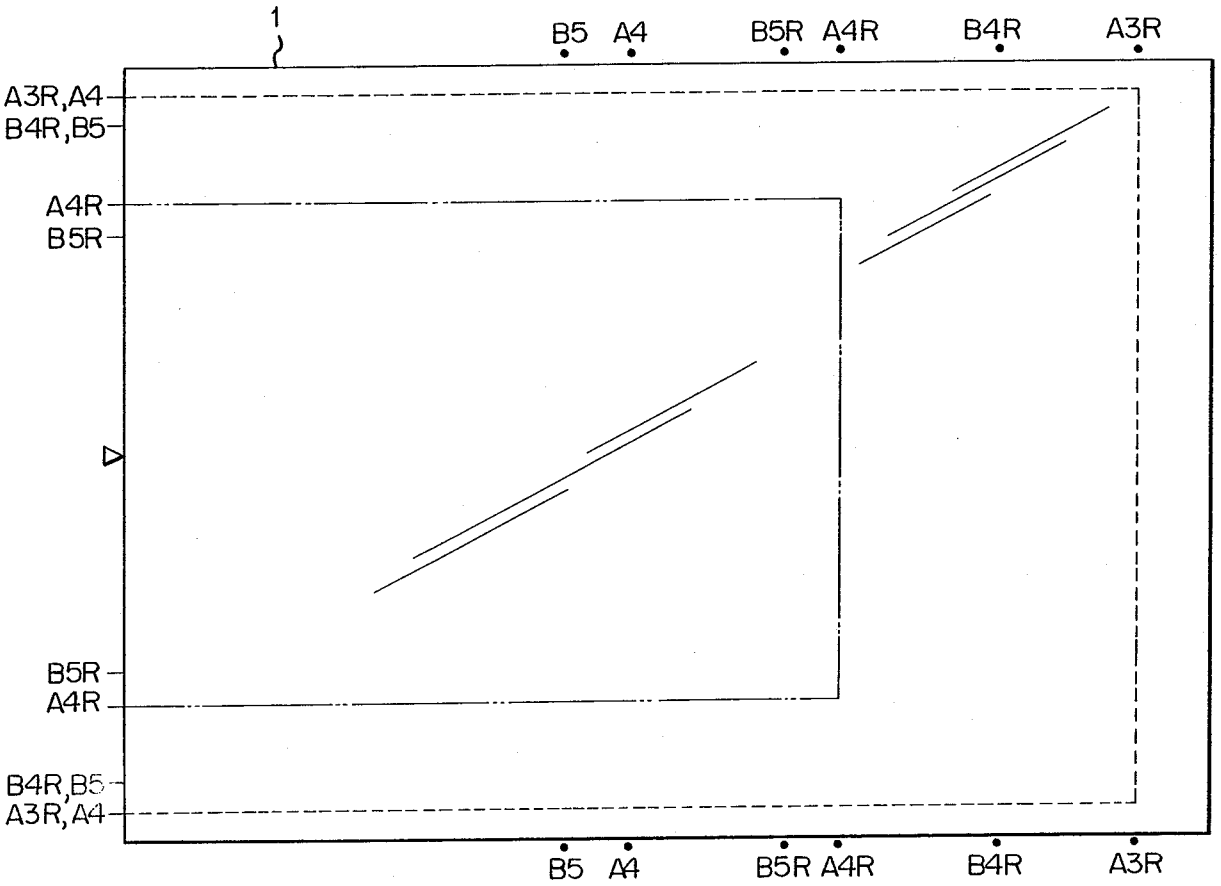
FIG. 1 is a plan view showing a glass platen of a copier.

How to use the editor board 500 will be outlined. First, a desired document is laid on the board 502 with its edge aligned with the left end of the board 502 and with its center in register with the mark Δ (the board 502 being similar in appearance to the document set area of the glass platen 1 as shown in FIG. 1). Then, the key switch 510 is operated. When it is desired to extract a part of the document, the key switch 511 is operated to diagonally specify a desired area of the document. For example, to extract a rectangle ABCD shown in FIG. 13B, the diagonal corners A and D or B and C are marked with the tip of the light pen 505. In response, the editor controller 501 transfers to the main control board 200 area data which are representative of the X coordinate of the side AB, the X coordinate of the side CD, the Y coordinate of the side AC, the Y coordinate of the side BD, and data representative of partial extraction. To erase a limited area of the document, after the the key switch 501, the key switch 510 is operated to specify the desired area in the same manner as stated above. In response, the editor controller 501 delivers to the main control board 200 the area data and data representative of partial erasure.

Figure 13B:
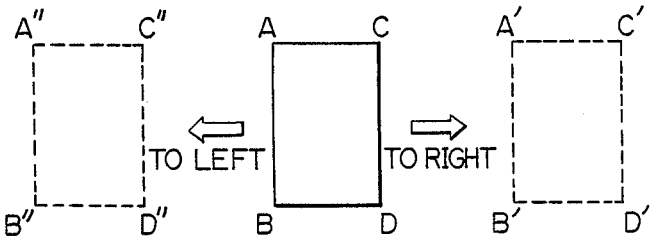
FIG. 13B is a schematic diagram useful for explaining how an area is specified by the editor and how an image to be recorded is shifted.

Further, to shift a limited part of the document image, after the key switch 510, the key switch 513 is operated. Thereafter, any desired point before the movement is entered by using the light pen and, then, a position to which that point is to be moved is entered. In this particular embodiment, since movement is allowed in the X direction only, the Y coordinate of the position to which the point is to be moved is open to choice. Specifically, as shown in FIG. 13B, when it is desired to move the area ABCD to the right for recording A'B'C'D', the point A may be entered and, then, any point on the side A'B'. When it is desired to move the area ABCD to the left for recording Annn"B"C"D", the point D may be entered and, then, any point on the side C"D". In any case, the gist is that the first input and the second input be maintained in the same relation with respect to the X coordinate. In response to such inputs, the editor controller 501 transfers to the main control board 200 shift data which treat the right shift as a positive shift and the left shift as a negative shift.

The main control board 200 executes the copying process previously stated by controlling the various sections of the copier. In the centering mode or the shift mode in which movement of an image occurs, the main control board 200 executes the process by setting up different timings with regard mainly to the sheet drive timing of the register roller 27, the erase timing, and the scanning start timing of the scanning system 30.

Since the characteristic of this particular embodiment is especially prominent in relation to a case wherein in the centering mode or the shift mode a P sensor pattern toner image is formed to sense developer density, such a case will be briefly described.

Figure 14A:
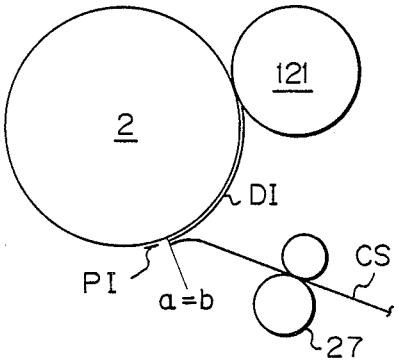
FIGS. 14A, 14B and 14C are schematic views each showing a particular relationship between a copy sheet, a toner image corresponding to a reference density pattern and a toner image corresponding to a document image and a photoconductive drum in a mode which is available for shifting an image.

FIG. 14A shows a normal mode in which an image is not shifted. In this mode, the sheet drive timing of the register roller 27 and the scanning start timing of the optical system 30 are selected such that the leading end b of a toner image corresponding to a document (except for a case wherein no image is printed on the document) and the leading end a of a copy sheet CS align with each other. Hence, the P sensor pattern toner image PI formed before the leading end of the toner image which corresponds to the document is not transferred to the copy sheet CS. Although the P sensor pattern 13 is continuously illuminated until scanning begins (see FIG. 10), when a latent image corresponding to a predetermined width is formed, it is erased over the entire width by the eraser 4.

Figure 14B:
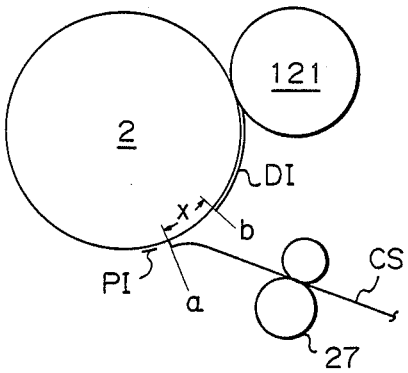

FIG. 14B shows a sheet first mode in which an image is to be shifted to the right, i.e. in the positive direction with respect to the X coordinate. In this mode, the sheet drive timing of the register roller 27 and the scanning start timing of the optical system 30 are selected such that the leading end a of the copy sheet CS is located ahead of the leading end b of the document toner image by a specified amount of shift x, whereby the scanning start timing is delayed by x compared to the normal mode. Again, although the P sensor pattern 13 is continuously illuminated until scanning begins, when a latent image corresponding to a predetermined width is formed, it is erased over the entire width by the eraser 4. In his case, therefore, the entire width erasure by the eraser 4 is extended by x compared to the normal mode. The P sensor pattern toner image PI is not transferred to the copy sheet CS which precedes the leading end of the document toner image.

Figure 14C:
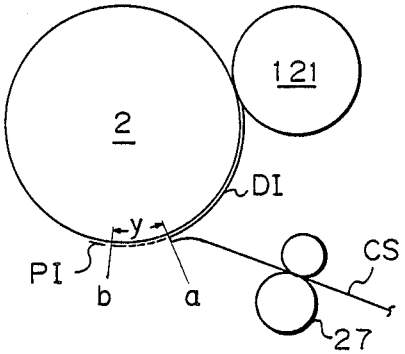

FIG. 14C shows a sheet second mode in which an image is to be shift to the left, i.e. in a negative direction with respect to the X coordinate. In this mode, the sheet drive timing of the register roller 27 and the scanning start timing of the optical system 30 are such that the leading end a of the copy sheet CS is positioned rearward of the position b corresponding to the leading end of the document toner image by a specified amount of shift y, so that the sheet drive timing is delayed by y compared to the normal mode. While the P sensor pattern 13 and the document are scanned in the same manner as in the normal mode, when a latent image of the P sensor pattern corresponding to a predetermined width is formed, the eraser 4 located above the drum 2 is activated to erase the entire width down to that portion of the drum 2 which is to be transferred to the leading end a of the copy sheet CS. Specifically, the full width erasure by the eraser 4 is extended by y compared to the normal mode. Consequently, that part of the document latent image which is not to be transferred to the copy sheet CS is erased to save toner.

The procedure described above will be stated in relation to the centering mode. In the centering mode, the amount of shift is determined based on document size data, copy sheet size data, and magnification data which are keyed in. Since the document size is not enlarged or reduced or is enlarged or reduced by a magnification selected, an image which will be produced by projecting a document area to a copy sheet is obtainable by multiplying the document size data by the magnification data. When the document area DH projected is smaller than the area of the copy sheet CS as shown in FIG. 2A, the difference 2x1 in X coordinate between the two areas is distributed to the right and the left of the area DH, as shown in FIG. 2B. Specifically, the sheet first mode in which an image is to be shifted in the positive direction with respect to the X coordinate by a distance of x1 is set up, so that the area DH is shifted to the center of the copy sheet CS. In this condition, the P sensor pattern toner image is produced in a position ahead of the leading end of the copy sheet CS. On the other hand, when the document area DH projected is larger than the area of the copy sheet CS as shown in FIG. 3A, a difference 2y1 in X coordinate between the two areas is distributed to the right and the left of the copy sheet CS (yl being represented by a negative value), as shown in FIG. 3B. Specifically, the sheet second mode in which an image is to be shifted by a distance of y1 in the negative direction with respect to the X coordinate is set up, thereby shifting the copy sheet to the center of the area DH. In this case, the P sensor pattern toner image is produced in a position which precedes the leading end of the area DH, as shown in FIG. 3C.

The edit mode is as follows. In this mode, shift data is fed from the editor controller 501 of the editor board 500. When shift data for shifting the image DP4 of FIG. 4A by x2 in the positive direction with respect to the X coordinate is applied, the sheet first mode is selected to cause the copy sheet CS to precede the area DH by x2 so that the image DP4 is shifted as shown in FIG. 4B. In this condition, the P sensor pattern toner image is formed in a position ahead of the copy sheet CS, as shown in FIG. 4.

Figure 5B:
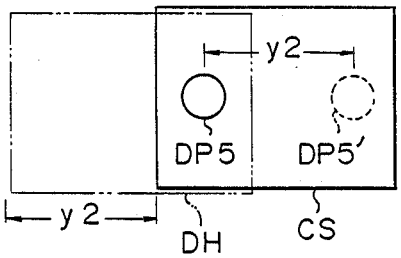
Figure 5C:
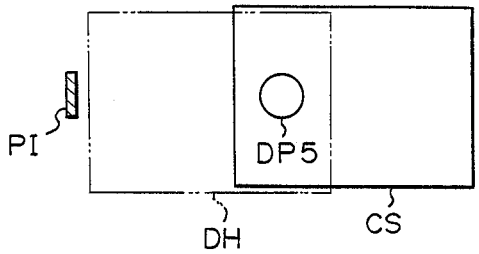
Figure 5D:
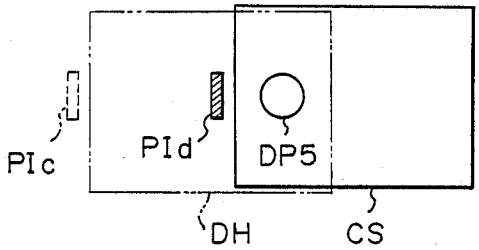

Further, when shift data for shifting the image DP5 of FIG. 5A by y2 in the negative direction is applied (i.e. y2 being represented by a negative value), the sheet second mode is selected so that the copy sheet CS is delayed relative to the area DH by y2, thereby shifting the image DP5 as shown in FIG. 5B. In this case, the P sensor pattern toner image is formed in a position ahead of the leading end of the area DH, as shown in FIG. 5C.

A specific operation of the main control board 200 will be described with reference to FIGS. 16 to 26.

Figure 16:
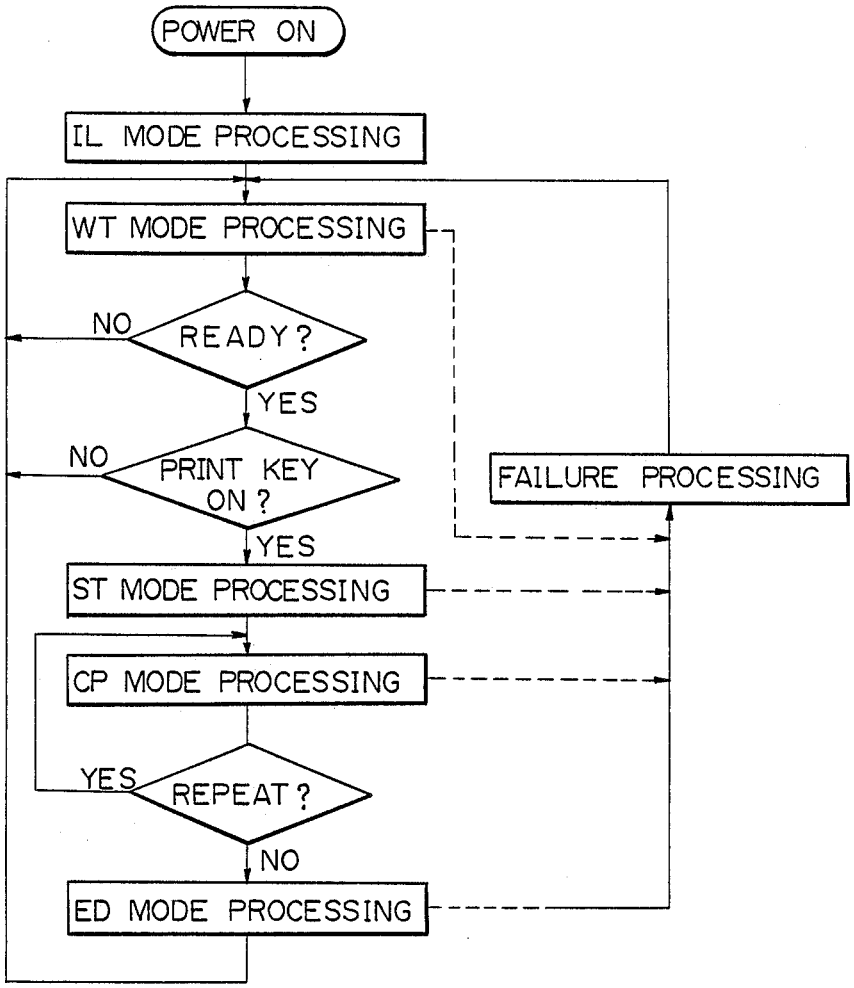
FIGS. 16, 17A, 17B, 18, 19, 20, 21, 22, 23, 24 and 25 are flowcharts outlining the operation of the main control board of FIG. 9.

FIG. 16 shows a general routine of the main control board 200. As shown, the general routine begins with initialize (IL) mode processing. The IL mode processing is comprised of clearing the RAM 230, initializing various mode settings, resetting the output ports to thereby initialize the main control board 200 itself, and initializing the various boards and units connected to the board 200 for thereby initializing the entire copier. This causes the copier into a standard mode. Then, the main control board 200 repeatedly executes wait (WT) mode processing until the copier becomes ready and the print start key KS is depressed. The WT mode processing begins with reading the statuses of signals which are applied to the various input ports and, then, storing the results in the storage 230. Subsequently, a group of data stored in the storage 230 and adapted for output control are delivered to their associated output ports in order to control structural elements which are connected to the output ports. Further, the statuses of the various input ports stored in the storage 230 as stated above are checked for failures. If any failure is found, predetermined failure processing is executed. If not failure is found, the statuses of the other input ports are checked so as to, for example, execute input read processing for reading inputs which may be keyed in on the operation board 310.

Figures 1, 17A:
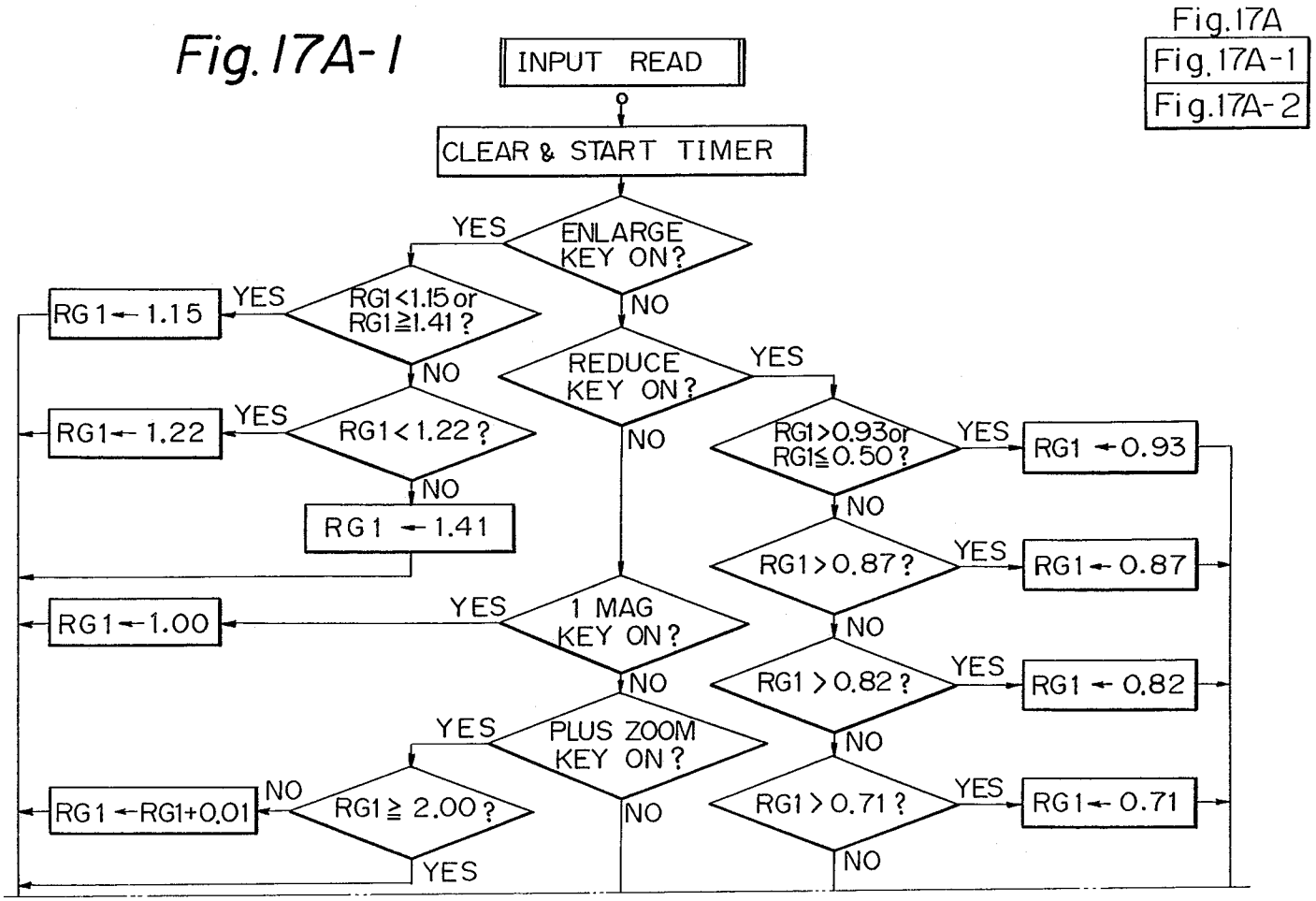
Figures 2, 17A:
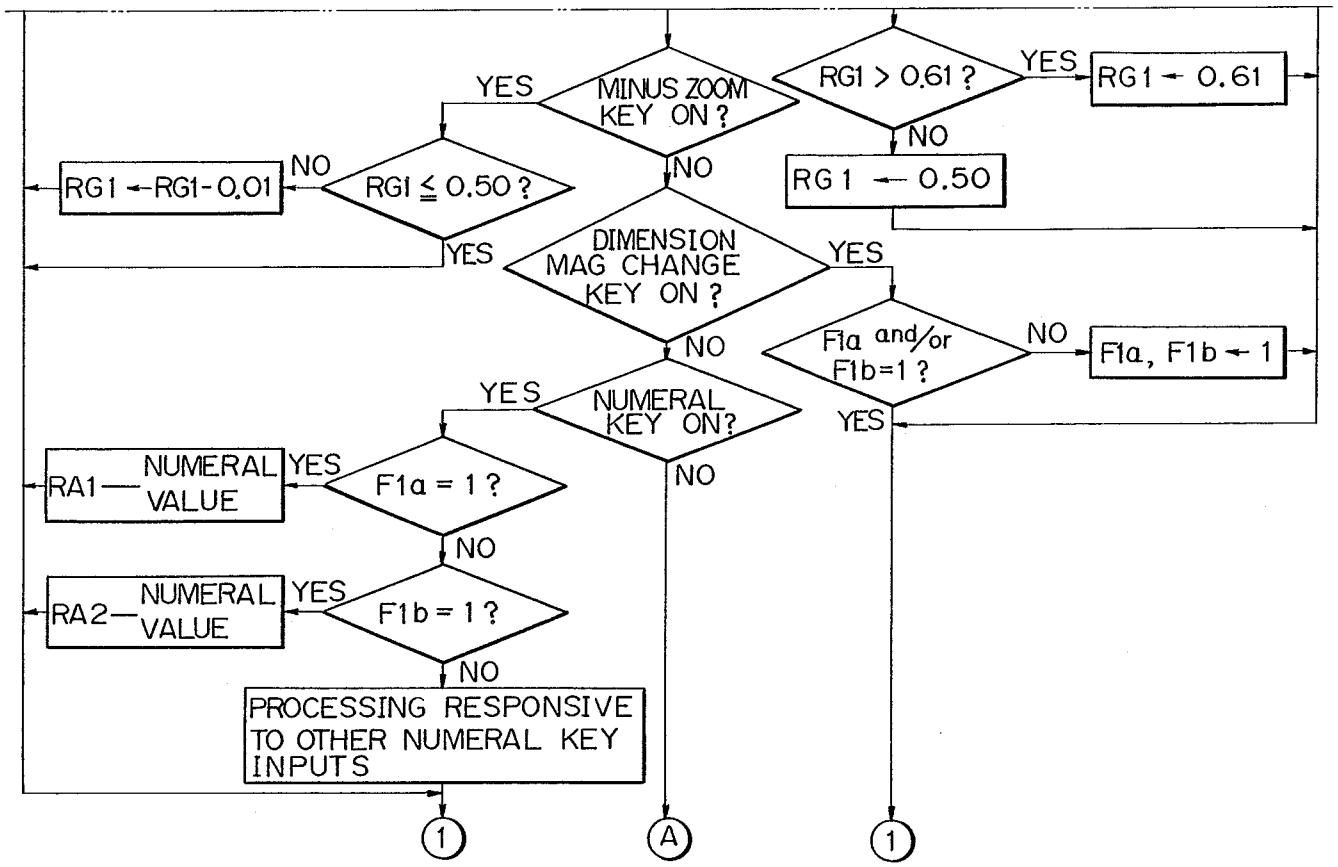

Referring to FIGS. 17A nd 17B, a major part of the input read processing is shown. In this processing, a timer adapted to count a key-on time is cleared and then started.

When the enlarge key K9b for updating the fixed ratio of magnification change to the enlarging side is operated, the fixed ratio is updated. In the case of enlargement, since any one of fixed ratios of 1.15 magnification (115%), 1.22 magnification (122%) and 1.41 magnification (141%), a magnification being loaded in the register RG1 is referenced to set a greater magnification than it every time the key is depressed, the new magnification being loaded in the register RG1. If the magnification being loaded in the register RG1 is greater than 1.41, 1.15 magnification is set and loaded in the register RG1.

When the reduce key **K9*c* for updating the fixed magnification to the reducing side is depressed, the fixed magnification is updated. In the case of reduction, since any one magnification of 0.93 (93%), 0.87 (87%), 0.82 (82%), 0.71 (71%), 0.61 (61%) and 0.50 (50%) can be selected, the magnification being loaded in the register RG1 is reference to update it with a smaller magnification than it every time the key K9*c* is depressed, the new magnification being loaded in the register RG1**. If the magnification being loaded in the register RG1 is smaller than 0.50, 0.53 magnification is set and loaded in the register RG1.

When the 1 magnification key K9*a* is depressed, the magnification is set to 1.00 and loaded in the register RG1.

When the plus zoom key K6*a* for increasing the ratio of magnification change on a 1 % basis is operated, the value loaded in the register RG1 is increased by each 0.01. If the value of the register RC1 is 2.00, the operation is cancelled. Specifically, the maximum enlargement available with this particular embodiment is 200% (linear ratio).

When the minus zoom key K6*b* for decreasing the ratio of magnification change on a 1 % basis is operated, the value loaded in the register RG1 is decreased by each 0.01. If the value of the register is 0.50, the operation is cancelled. Specifically, the minimum reduction available with this embodiment if 50% (linear ratio).

When the dimension magnification change key K5 is operated, if a dimension magnification change mode has not been set, flags F1*a* and F1*b* are set (logical ONE); if the flags F1*a* and F1*b* have been set to set up the dimension magnification change mode, the operation is cancelled.

When any of the numeral keys K10 is operated, a numerical value corresponding to the key input is loaded in the register RA1 provided the flag F1*a* has been set. Thereafter, when the # key K# is operated, the flag F1*a* is set according to the flow of FIG. 17B so that in response to the next numeral key input a numerical value corresponding thereto is loaded in the register RA2 (F1*a* reset and F1*b* set). Upon the subsequent operation of the # key K#, the flat F1*b* is reset according to the flow of FIG. 17B. As a result, a value produced by dividing the value of the register RA2 by that of the register RA1 is loaded in the register RG1 as a ratio of magnification change. For example, one can set a ratio of magnification change of 200% simply by selecting the dimension magnification change mode, then entering numerical value "1" on the ten key K10, then operating the # key K#, then entering numerical value "2" on the ten key K10, and then operating the # key K#. In the case that the ratio of magnification change is more than 200 % or less than 50%, there is set a ratio of 200 % or 50 %.

The ratio of magnification change set by the above procedure appears on the display D4. In an optics control routine, not shown, in the WT mode, the optics control board 320 is controlled by the ratio of magnification change.

While the dimension change mode is not set, e.g., in the copy number set mode, a numerical value corresponding to a numeral key or keys operated is loaded in a copy number register.

Figures 1, 2, 17B:
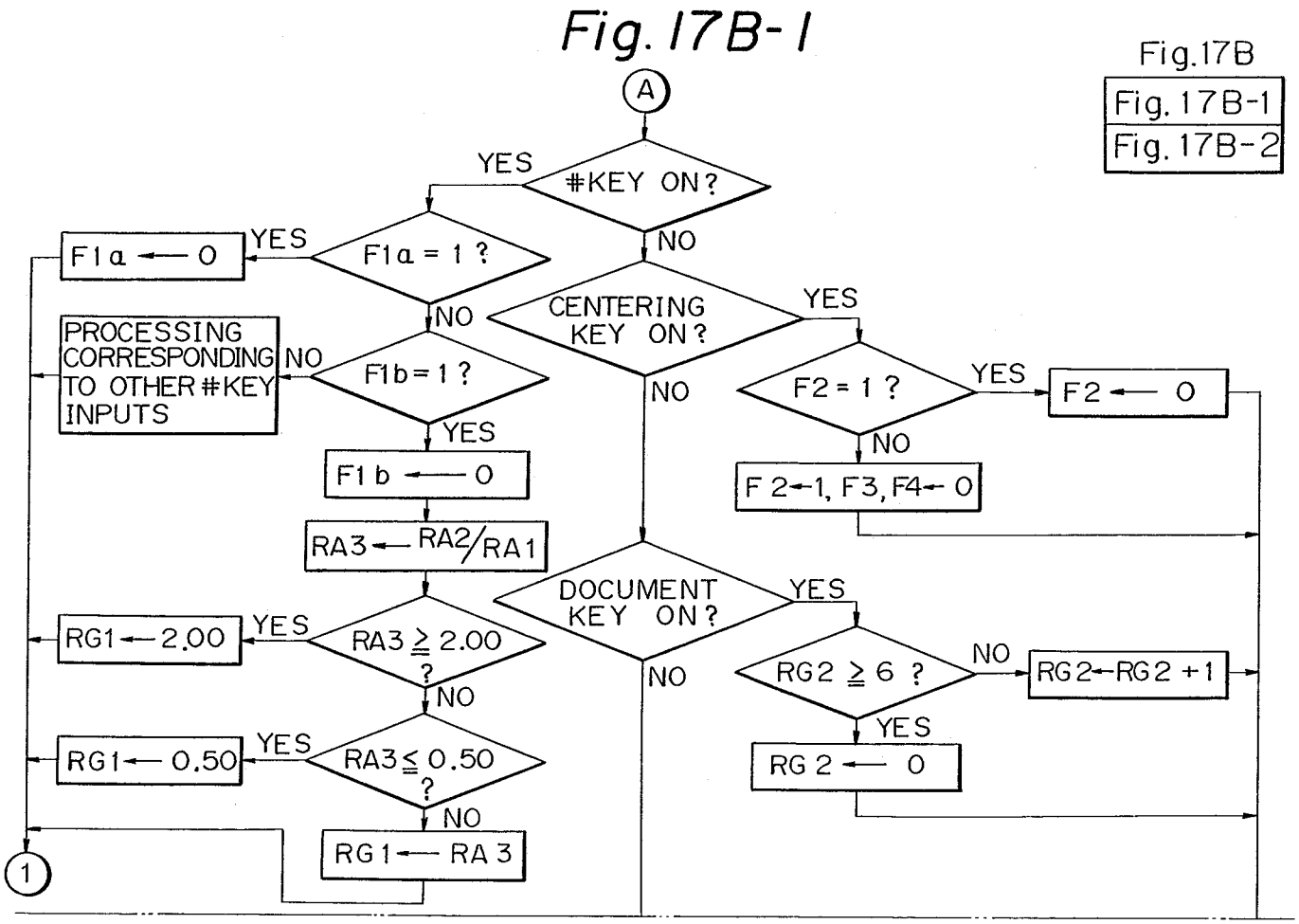
Figures 2, 17B:
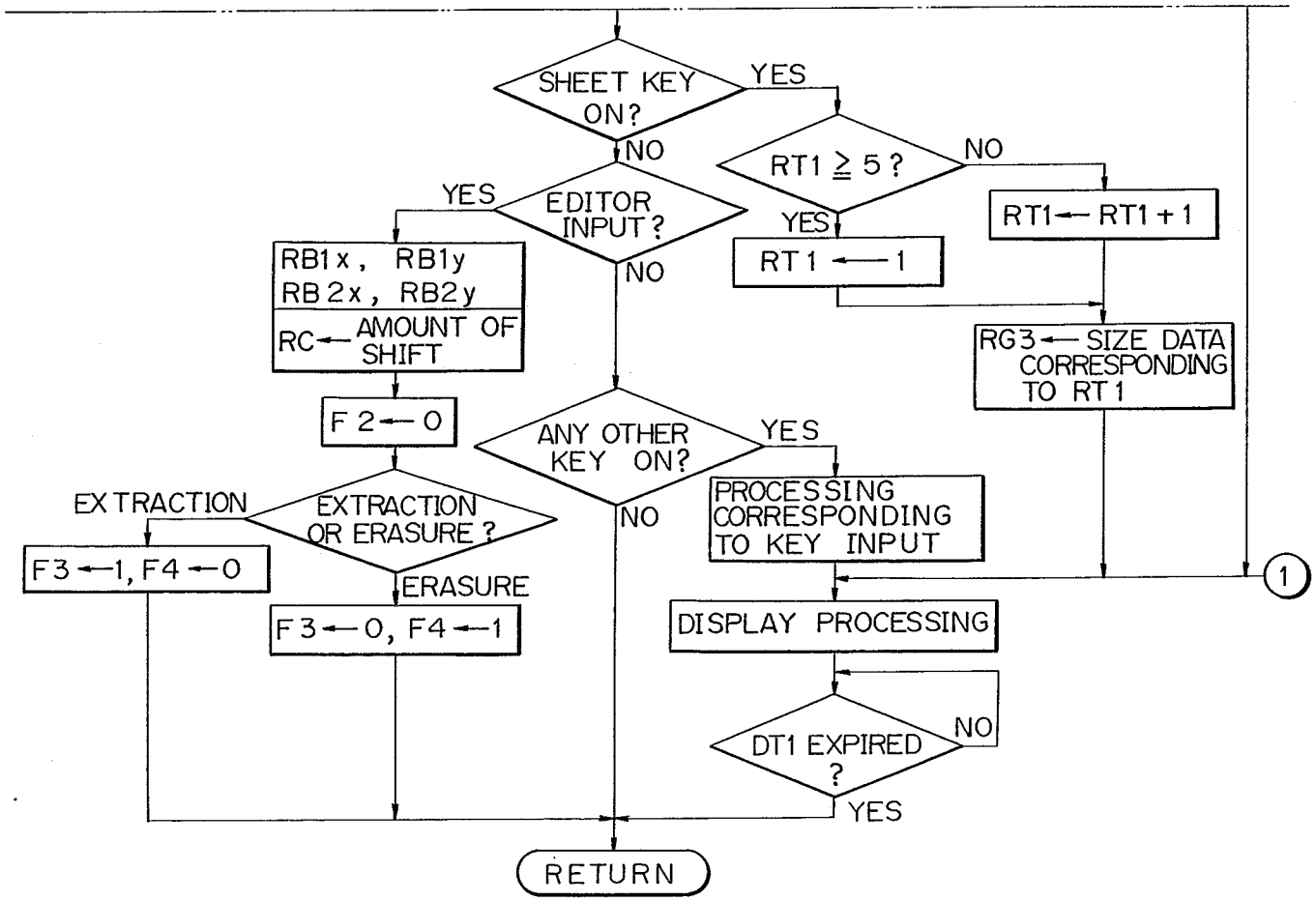

As shown in FIG. 17B, when the centering key Kctr is depressed, if the centering mode has been set (F2 set), the flag F2 is reset; if the centering mode has not been set, the flag F2 is set and flags F3 and F4, which will be described, are rest.

When the document key K8 is depressed, the value loaded in a register RG2 is incremented by 1. As regards the value of the register RG2, "1" is representative of format A3, "2" format B4, "3" format A4, "4" format B5, "5" format A5, and "6" format B6. When the document key K8 is operated while the value of the register RG2 is "6", the register RG2 is reset to "0" indicating that no document size has been set.

When the sheet key K11 is operated, a register RT1 is incremented by 1. As regards the value of the register RT1, "1" is representative of the first sheet feed system, "2" the second sheet feed system, "3" the third sheet feed system, "4" the fourth sheet feed system, and "5" the fifth sheet feed system. When the document key K11 is operated while the register RT1 is loaded with "5", the register RT1 is set to "1" so that the first sheet feed system is selected. Sheet size data associated with the sheet feed system being selected is stored in a register RG3.

In response to an editor input, X and Y coordinate data representative of the previously stated area are read and individually loaded in registers RB1x, RB1y, RB2x, and RB2y while, at the same time, shift data is stored in a register RC. While an editor input is present, the flag F2 is reset because the centering mode is invalidated. Thereafter, the flag F3 is set and the flag F4 reset based on area extraction data or, alternatively, the flag F3 is reset and the flag F4 set based on area erasure data.

When any other key is depressed in addition to the above-mentioned ones, an operation mode corresponding to that key is set up while, at the same time, display data stored in the storage 230 beforehand is delivered to a predetermined output port at a predetermined timing so as to appear on any of the indicators which are provided on the operation board 310.

Figure 25:
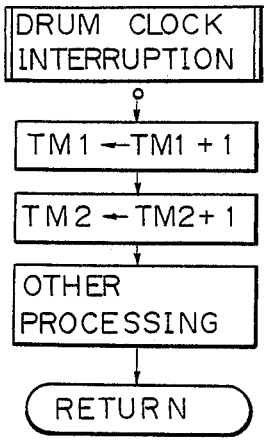

The WT mode stated above is repeated while the copier is not ready or while the print start key KS is not operated. The copier does not become ready when the fixing temperature does not lie in a predetermined range and when some failure is detected. When the print start key KS is depressed under the ready state of the copier, pre-copy mode processing (start (ST) mode processing) is executed in which data associated with the shift of an image are rearranged and, as processing which occurs immediately before the start of the copying process, there are effected the start of the main motor, pre-copy cleaning of the drum, etc. After the ST mode processing, drum clock interrupt processing shown in FIG. 25 is executed in response to timing pulses which are synchronous to the rotation of the main motor, whereby a first timing counter TM1 and a second timing counter TM2, which will be described, are incremented by 1 each.

Figure 18:
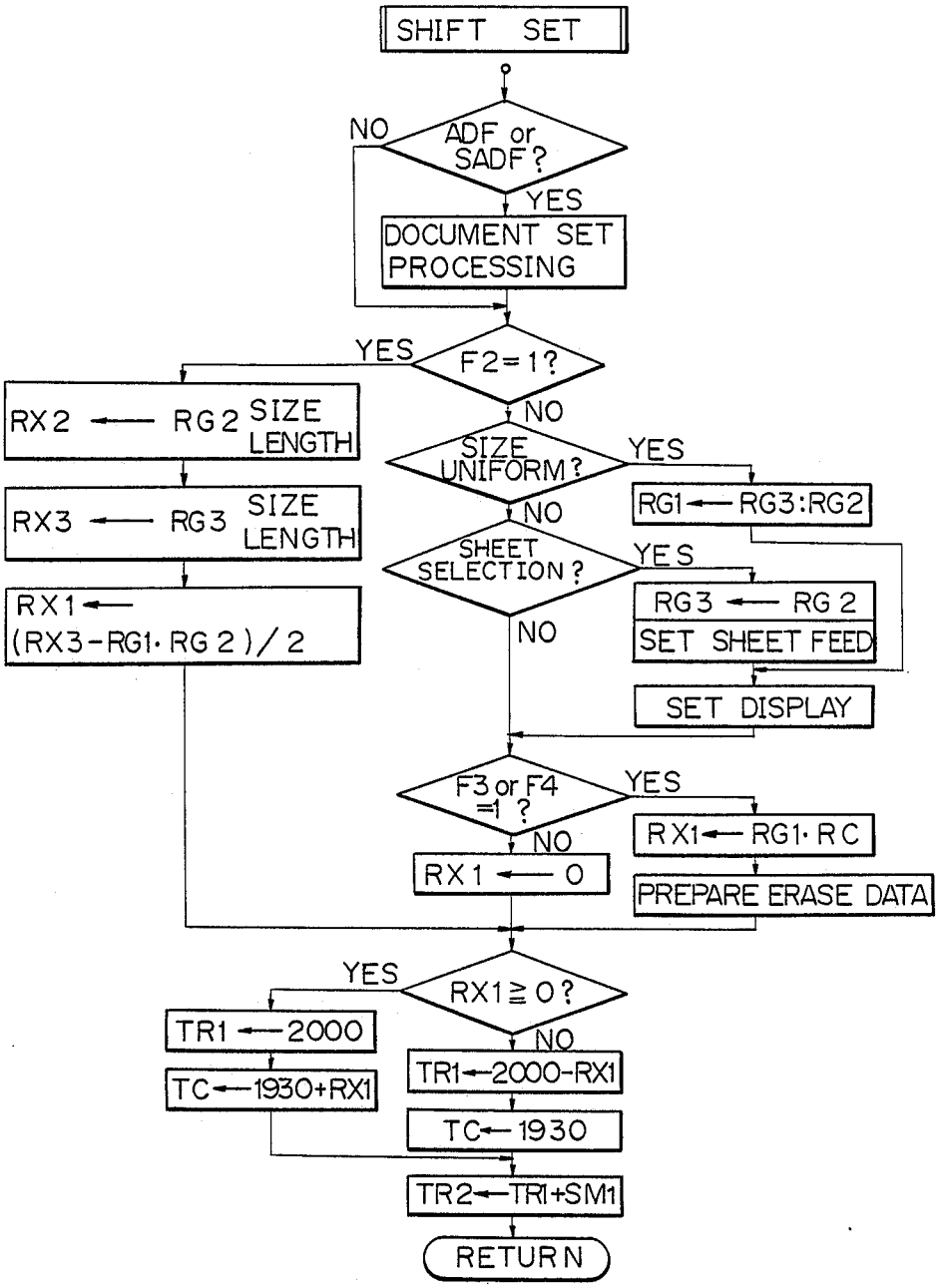

FIG. 18 shows a shift set routine which is included in the ST mode processing. As shown, while the ADF mode or the SADF mode is selected, there is effected document set processing for applying an ADF start command to the ADF 60 to set a document in a predetermined position on the glass platen 1. At this instant, the size of the document is read and loaded in the register RG2 while, at the same time, a flag for the discrimination between a long side horizontal orientation and a short side horizontal orientation. In the centering mode, since the flag F2 has been set, the register RX2 is loaded with data indicative of the document length (in terms of the number of timing pulses) in the X direction as represented by the content of the shift register RG2, and the register RX3 is loaded with data indicative of the sheet length (in terms of the number of timing pulses) in the X direction as represented by the content of the register RG3. Thereupon, the content of the register RG2 is multiplied by the ratio of magnification change which is indicated by the register RG1, the product being representative of the length of the projected image of the document area in the X direction. Then, the difference between the product and the content of the register RX3 is divided by 2 and stored in the register RX1. Specifically, the value loaded in the register RX1 is positive or negative and representative of the shift data x1 or y1 previously mentioned.

In a size uniformalize mode which may be selected by the key K2, a ratio of magnification change which matches a document size as indicated by the register RG2 to that of a sheet as indicated by the register RG3 is set and stored in the register RG1 and, then, that ratio is indicated on the display D4. In a sheet select mode which may be set up by the key K2, one of the sheet feed systems which is loaded with sheets of a size equal to that of a document, which is indicated by the register RG2, is set and displayed on the display D3. While the flag F3 or F4 is set, meaning that shift data has been stored in the register RC, the shift data is compensated by the ratio of magnification change set and, then, stored in the register RX1. At the same time, erase data on the area to be transferred to a sheet are prepared for each subscanning and based on the area data, the erase data being written in the storage 230. While both the flags F3 and F4 are reset, "0" is loaded in the register RX1.

Subsequently, the sheet drive start timing RB1 and sheet drive end timing RT2 of the register roller 27 and the scanning start timing RC of the scanning system 30 are set based on the content of the register RX1. The timings represented by numerical values 2000 and 1930 are respectively the sheet drive start timing and the scanning start timing under a condition wherein the magnification is 1 and the third sheet feed system is selected, the sheet drive start timing and the scanning start timing each being read out of a ROM table of the storage 220. Hence, their values naturally depend upon the sheet feed system and the ratio of magnification change although described above by using specific numerical values. When the value stored in the RX1 is positive, i.e., when a positive shift in the X direction is to occur, the sheet drive start timing TR1 is unchanged, or set to 2000, while, at the same time, the scanning start timing TC is set to a value which retards the scanning start timing, which is the sum of 1930 and the value of the register RX1, by the value of the register RX1. When the value of the register RX1 is negative, meaning that a negative shift in the X direction is to occur, the sheet drive start timing TR1 is set to a value which retards the sheet drive start timing, which is the sum of 2000 and the value of the register RX1, by the value of the register RX1 while, at the same time, the scanning start timing TC is unchanged, or set to 1930. Further, a value SM1 representative of the sheet size in terms of the number of timing pulses is added to the sheet drive start timing RT1, the sum being set as the sheet drive end timing TR2.

Upon completion of the ST mode processing, copy (CP) mode processing is executed. Specifically, a sheet feed routine shown in FIG. 19, a registration routine shown in FIG. 20, an erasure routine shown in FIG. 21, an illumination routine shown in FIG. 22, a carriage drive routine shown in FIG. 23, and a toner supply routine shown in FIG. 24 are selectively performed depending upon the values of the timing counters TM1 and TM2.

Figure 19:
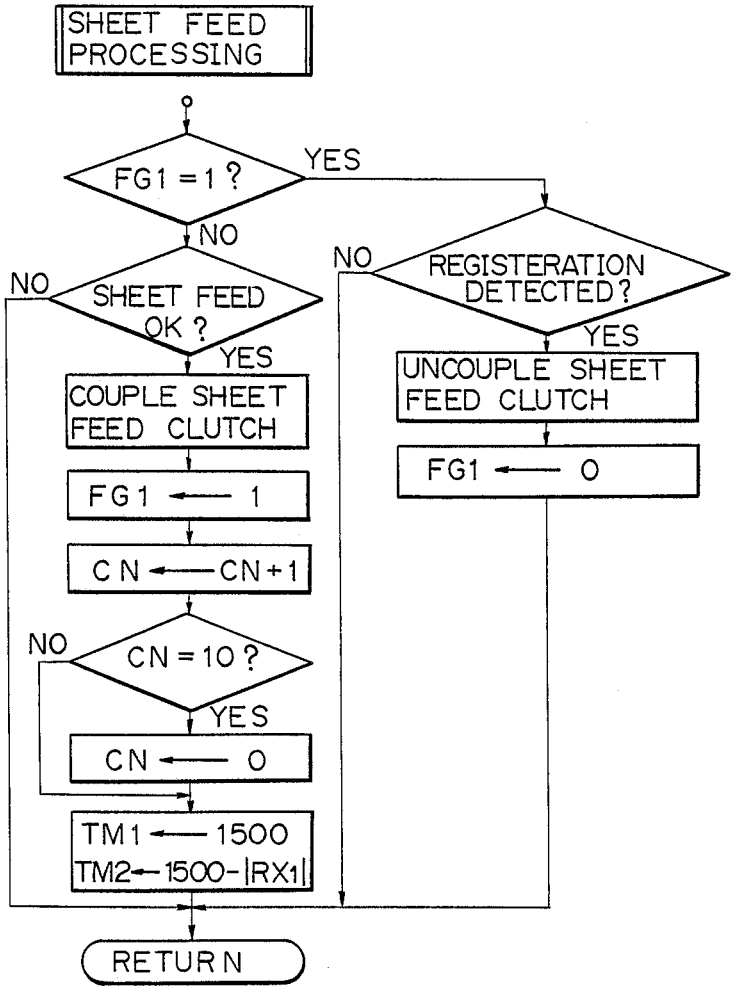

In the sheet feed routine of FIG. 19, when a sheet feed timing is reached, a sheet feed clutch for driving the sheet feed system is coupled, the flag FG1 is set, and a P sensor counter CN adapted to count P sensor detect timings is incremented by 1. In this particular embodiment, since toner density (developer) is detected once per ten copies, the counter CN is reset to "0" if it is 10". Thereupon, the first timing counter TM1 is set to "1500" (exemplary value adopted for the convenience of description) while, at the same time, the second timing counter TM2 is again set to a value which is produced by subtracting the absolute value of RX1 from "1500". Specifically, the elements which are controlled by the second timing counter are delayed when an image shift is to occur than when no image shift is to occur. Since the flag FG1 is set in the above condition, when this routine is executed next time, only the output of a regist sensor, not shown, is monitored; when it senses registration, the sheet feed clutch is uncoupled and the flag FG1 is reset.

Figure 20:
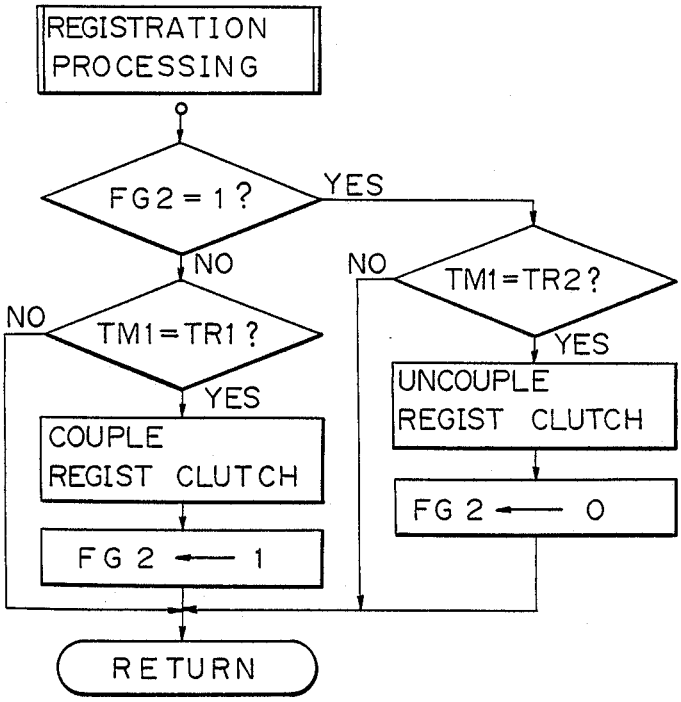

In the registration routine shown in FIG. 20, when the content of the first timing counter TM1 becomes equal to a timing TR1, i.e., the sheet feed start timing stated earlier, the regist clutch is coupled and the flag FG2 is set. Since the flag FG2 is set as mentioned, when the first timing counter TM1 reaches a timing TR2, i.e., the sheet feed end timing thereafter, the regist clutch is uncoupled and the flag FG2 is reset to finish the feed of a copy sheet.

Figure 21:
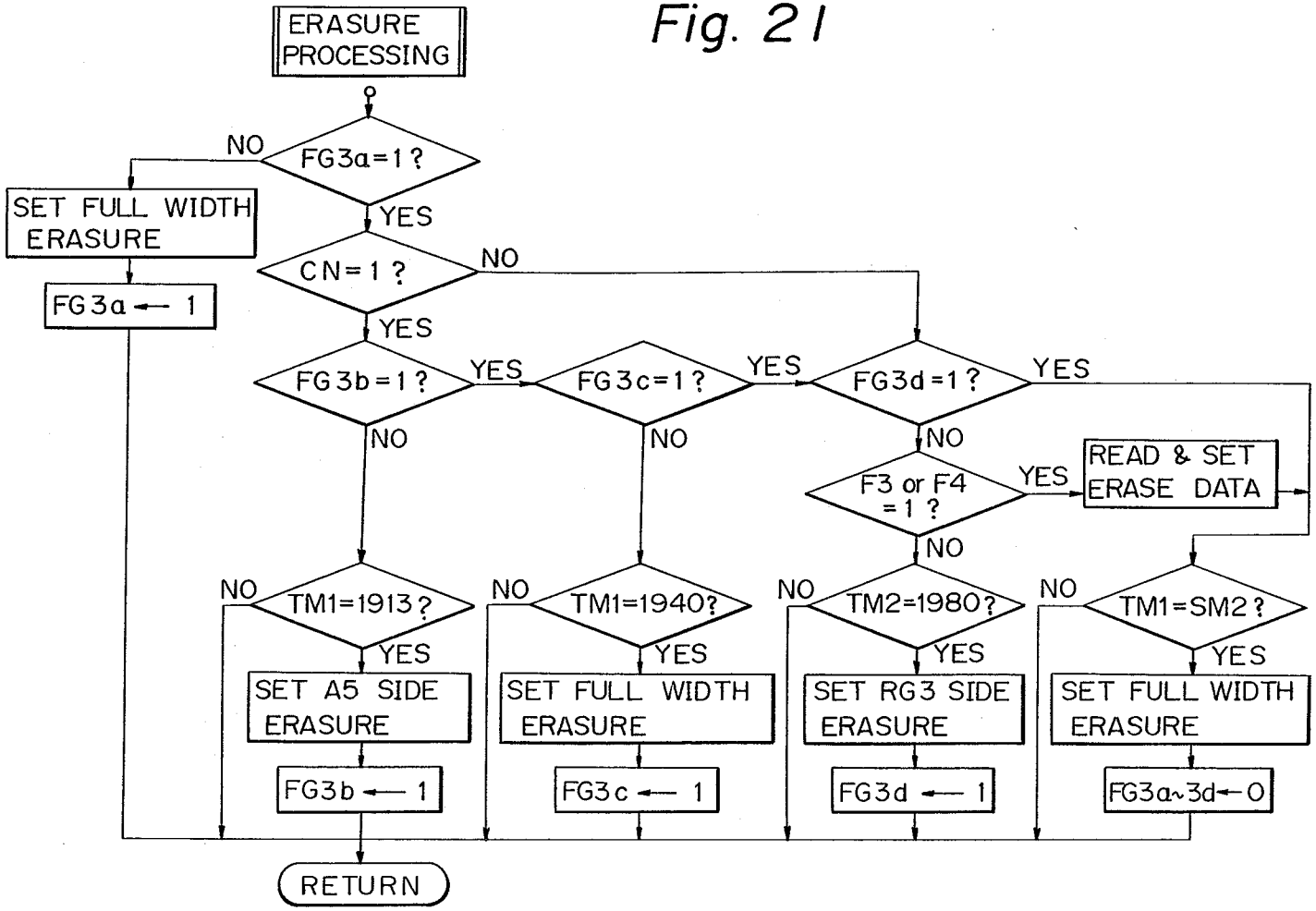

In the erasure routine shown in FIG. 21, since a flag FG3*a* is reset at first, the full width erasure is set and the flag FG3*a* is set. Then, a latch signal for turning on and off the eraser 4 timed to subscanning as previously stated is delivered to control the eraser 4. When the P sensor counter CN is "1", a P sensor pattern toner image is formed. Hence, the first timing counter TM1 reaches a timing "1913" at which the P sensor pattern image formation start position is brought to just below the eraser 4, side erasure common to that of A5 vertical feed is set and a flag FG3b is set. Subsequently, when the first timing counter TM1 becomes equal to a timing "1940" at which the P sensor pattern formation end position is brought to just below the eraser 4, the full width erasure is set again and a flat FGc is set.

Thereafter, when the second timing counter RM2 reaches a timing "1980", the document image formation start position will have been located just below the eraser 4 if no image shift is to occur, the document image formation start position will have been located just below the eraser 4 if a positive image shift with respect to the X coordinate is to occur, and the start point of the area which is to be transferred to a copy sheet will have been located just below the eraser 4 if a negative image shift with respect to the X coordinate is to occur. Hence, if the flags F3 and F4 are not set, side erasure corresponding to the sheet size as indicated by the register RG3 is set and a flag FG3*d* is set. If the flag F3 or F4 is set, erase data stored in the memory 230 are read out thereafter timed to subscanning so as to execute erasure setting.

When the first timing counter TM1 reachs a timing SM2 at which the document image formation end position is positioned just below the eraser 4 under a no image shift condition, the full width erasure is set again and the flags FG3*a*, FG3*b*, FG3*c* and FG3*d* are reset. Specifically, at this timing, when a positive image shift with respect to the X coordinates is to occur, the end point of the area to be transferred to a copy sheet is located just below the eraser 4 so that the subsequent part of the document image forming area which is not to be transferred to a copy sheet is erased. On the other hand, when a negative image shift with respect to the X coordinate is to occur, the document image formation end position is located just below the eraser 4 so that the subsequent part of the area which is to be transferred to a copy sheet and void of a document image is erased.

It is to be noted that if the P sensor counter CN is not "1", meaning that no P sensor pattern toner image is to be formed, the full width erasure is set until the second timing counter TM2 becomes equal to the timing "1980". This is followed by the same procedure as described above.

Figure 22:
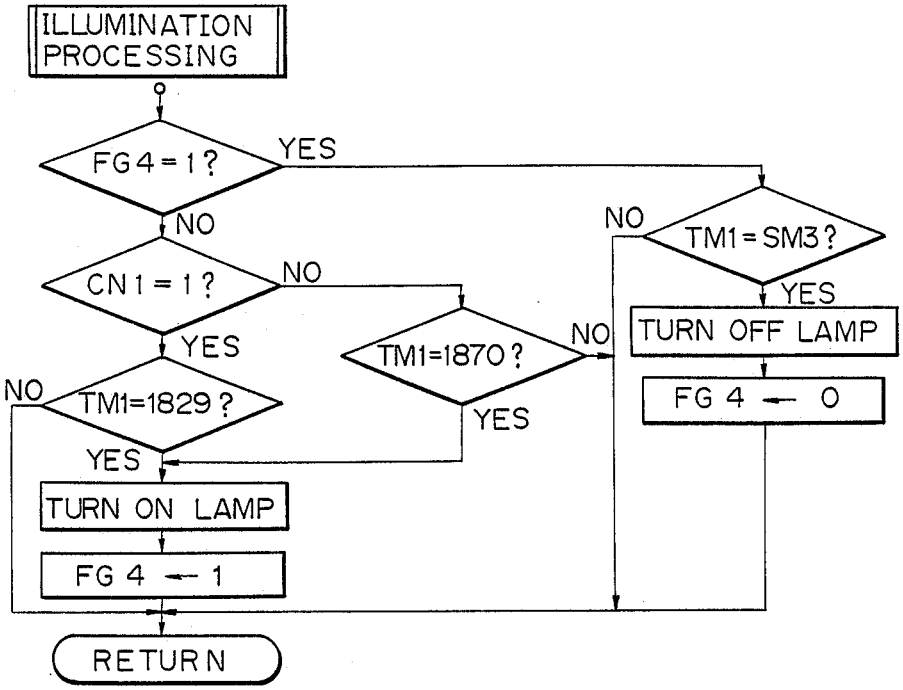

In the illumination routine shown in FIG. 22, since a P sensor pattern toner image is formed when the P sensor counter CN is "1", the lamp 31 is turned on when the first timing counter TM1 reachs a timing "1829" which is earlier than usual. If the P sensor counter CN is not "1", implying that a P sensor pattern toner image is not to be informed, the lamp 31 is turned on when the timing counter TM1 reachs the usual timing "1870" and, at the same time, the flag FG4 is set. Thereafter, as a timing SM3 (which depends upon the size of a copy sheet) at which the point just below the trailing end of the document reaches the read position of the scanning system 30, the lamp 31 is turned off and the flag FG4 is reset.

Figure 23:
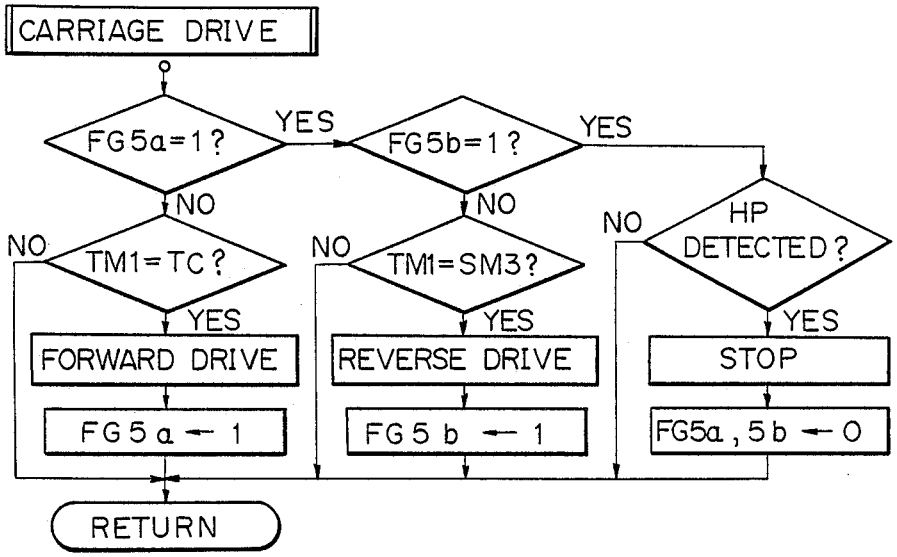
Figure 24:
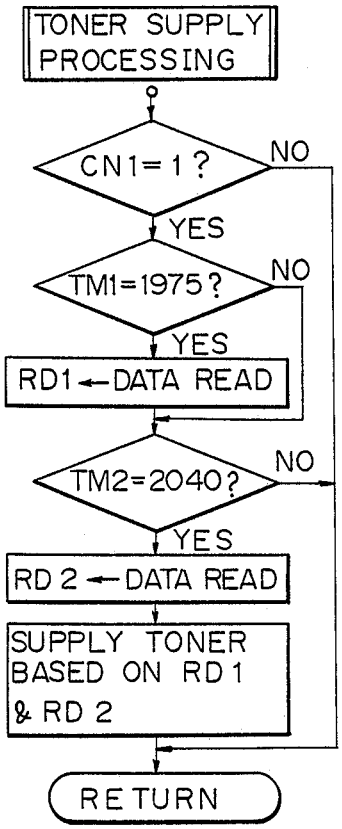

In the carriage drive routine shown in FIG. 23, when the first timing counter TM1 becomes equal to a timing TC, i.e., the scanning start timing previously stated, the first and second carriages are each driven forward at a predetermined velocity and a flag FG5*a* is set. Subsequently, when the first timing counter TM1 reaches a timing SM3 which depends upon the copy sheet size, the forward drive of the first and second carriages are stopped and, instead, reverse drive is started with a flag FG5*b* set. At the instant when the home position sensor, not shown, senses the home position, the reverse drive is stopped and the flags FG5*a* and FG5*b* are reset. Specifically, when a positive shift in the X direction is to occur (sheet first condition) the timing TC is delayed by specified amount of shift x ratio of magnification change and, therefore, the scanning start (carriage drive) timing is retarded. However, since the scanning end timing remains unchanged, the scanning range is reduced. Stated another way, when a positive shift in the X direction (sheet first condition), scanning ends at a position which precedes the end of the document by specified amount of shift x ratio of magnification change.

Further, in the toner supply routine shown in FIG. 24, since a P sensor pattern toner image is to be formed when the P sensor counter CN is "1", density data on the background area of the drum 2 output by the P sensor 6 is read and stored in a register RD1 when the first timing counter TM1 reaches a timing "1975". Then, at a timing "2040" at which the P sensor pattern toner image faces the P sensor 6, density data on the P sensor pattern toner image output by the P sensor 6 is read and stored in a register RD2. Thereupon, a toner supply table stored in the ROM is referenced based on the contents of the registers RD1 and RD2 so as to determine an amount of toner supply, followed by the supply of toner.

Figure 15:
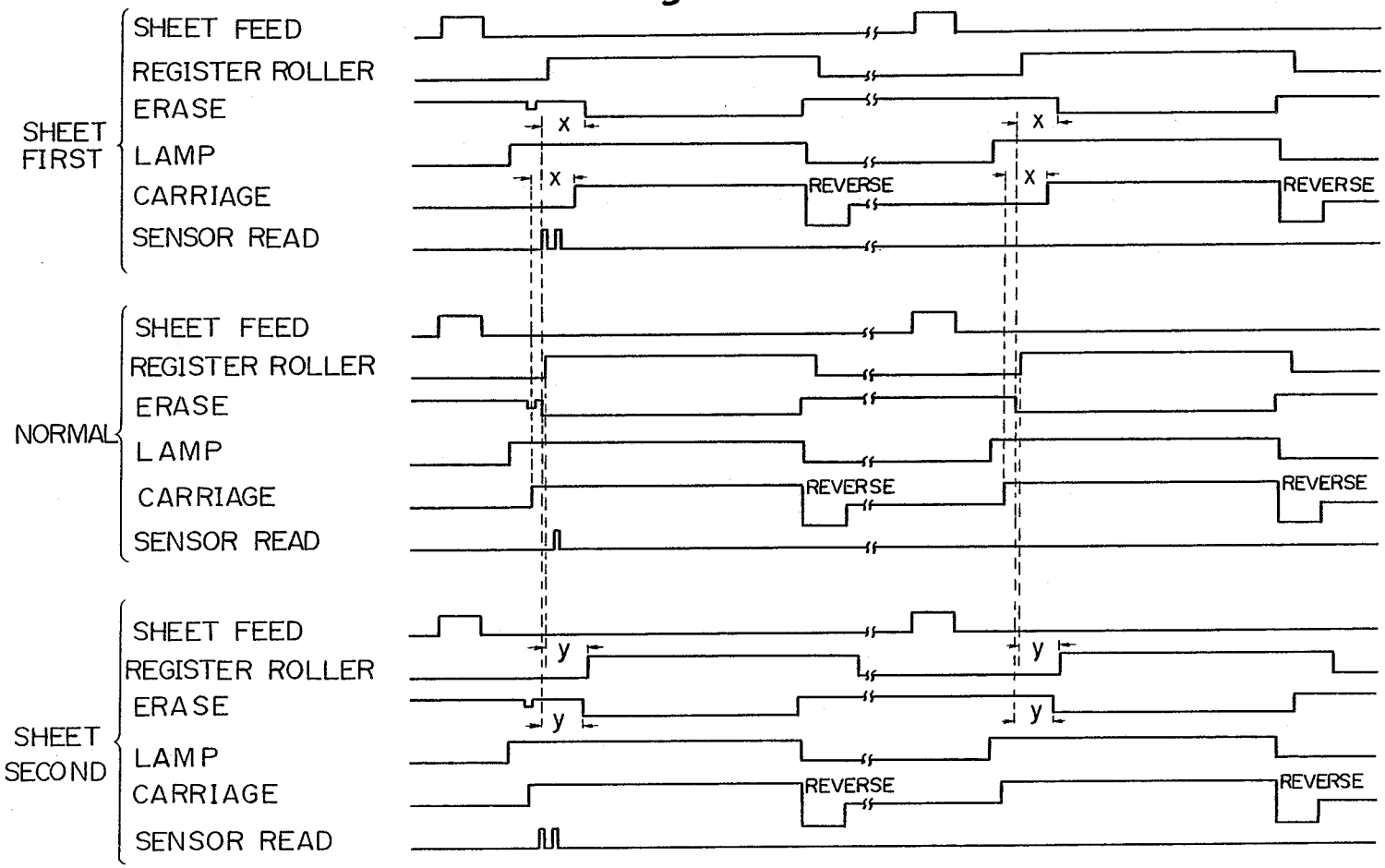
FIG. 15 is a timing chart demonstraiting the outline of operation of a main control board as shown in FIG. 9.

Referring to FIG. 15, there is shown a timing chart demonstrating the relationship between the sheet feed routine, registration routine, erasure routine, illumination routine, carriage drive routine, and toner supply routine as described above (with the sheet feed as a reference). It will be seen from FIG. 15 that in the sheet first mode, although the side erasure start and the carriage forward drive (scanning start) are each delayed by an amount of shift x (including compensation based on a ratio of magnification change; i.e. value of register RX1 when positive) relative to those of the normal mode, the side erasure end (full width erasure start) and the carriage reverse drive start (scanning end) are coincident with those of the normal mode. Specifically, the carriage is returned without forming a latent image corresponding to that of a document which is not to be transferred to a copy sheet, whereby the repeat processing is sped up. On the other hand, in the sheet second mode, although the register roller drive (sheet drive) start and the side erasure start, which depends upon the copy sheet, are delayed by an amount of shift y (including compensation by a ratio of magnification change; i.e. value of register RX1 when negative) relative to those of the normal mode, the side erasure end (full width erasure start) is coincident that of the normal mode. In this manner, a particular area which it not to be provided with a document latent image or not to be transferred to a copy sheet (except for the P sensor pattern area) is erased to promote efficient use of toner.

In the CP mode processing, while other various kins of processing are executed, they are not relevant to the characteristic features of this embodiment and, therefore, will not be described.

Referring to FIG. 16 again, when the CP mode processing is repeated to produce a desired number of copies (REPEAT), post-copy mode or end (ED) mode processing is executed. This processing includes discharging copies, cleaning the drum 2, etc. Upon completion of the copy discharge, the program returns to the WT mode processing.

In each of the WT mode processing, ST mode processing and ED mode processing, the states of the various structural elements are monitored at suitable timings and, when any failure is detected, failure processing is executed to stop the copier operation, produce an alarm, etc.

In summary, it will be seen that in accordance with the present invention, when a positive shift is commanded, a document latent image potential begins to be formed at a position which is rearward of a position of a charge carrier corresponding to the leading end of a recording medium by a specified amount of shift, and ends at a position located rearward of a transfer start position by a recording length, Hence, in FIG. 4B, for example, a latent image which extends over a distance of x2 from the trailing end of the copy sheet CS, i.e., a needless latent image which is not to be transferred to the copy sheet is not formed, whereby the recording speed is increased. Especially, when a document latent image potential forming means includes an optical reading means therein, scanning of a document area which does not need a latent image is omitted to enhance remarkably rapid recording.

Further, in accordance with the present invention, the position for forming a reference latent image potential is shifted relatively based on shift data which is representative of a position for transferring a visible image of a document latent image potential to a recording medium. This prevents a visible image of the reference latent image potential from being recorded on a recording medium while preventing the density of an unexpected portion of a charge carrier from being decided to be the density of the visible image of the reference latent image potential. Hence, adequate developer density control is achievable even with a recording apparatus of the type capable of setting up any desired recording position on a recording medium.

Various modifications will become possible for those skilled in the art after receiving the teachings of the present disclosure without departing from the scope thereof.

What is claimed is:

1. A device installed in an image recording apparatus for controlling developer density, comprising:

a charge carrier;

a reference latent image potential forming means for forming a reference latent image potential in a relatively small area of the charge carrier;

a record latent image potential forming means for forming on the charge carrier a record latent image potential corresponding to an image which is to be recorded;

a developing means for producing visible images each corresponding to a respective one of the reference latent image potential and record latent image potential which are produced on the charge carrier;

a developer density adjusting means for adjusting density of a developer which is stored in the developing means;

an optical sensing means located downstream of the developing means to face the charge carrier;

a transferring means for transferring the visible image of the record latent image potential to a predetermined recording medium;

an inputting means for inputting shift data which is representative of a position for transferring the visible image of the record latent image potential to the recording medium; and a control means for setting a record latent image potential form timing, a transfer timing and a reference latent image potential form timing based on the input shift data, and controlling the reference latent image forming means at said reference latent image potential form timing, the record latent image potential forming means at said record latent image potential form timing, and the transferring means at said transfer timing, and controlling the developer density adjusting means based on density of the visible image of the reference latent image potential which is sensed by the optical sensing means.

2. A device as claimed in claim 1, wherein the control means, when the shift data is representative of no shift, sets a record latent image potential form timing and a transfer timing for causing a leading end of the recording medium to align with a record latent image potential formation start position on the charge carrier at which formation of the record latent image potential begins, and a reference latent image potential form timing for defining a reference latent image potential formation start position on said charge carrier, at which the reference latent image potential begins to be formed, at a position which is on a positive side by a predetermined amount with respect to said record latent image potential formation start position, when said shift data is representative of a positive shift, sets a record latent image potential form timing and a transfer timing for causing the leading end of the recording medium to be positioned on the positive side by a specified amount of shift with respect to the record latent image potential formation start position, and a reference latent image potential form timing for defining the reference latent image potential formation start position which is on the positive side by said specified amount with respect to said record latent image potential formation start position.

3. A device as claimed in claim 2, wherein the charge carrier comprises a photoconductive element, and the reference latent image potential forming means comprises a charging means for charging said photoconductive element, a reference pattern having reference reflectivity, and an optical reading means for illuminating said reference pattern to guide a reflection from said reference pattern to said photoconductive element.

4. A device as claimed in claim 3, wherein the record latent image potential forming means comprises:

a charging means for charging the photoconductive element;

an optical reading platen to be loaded with a document, and an optical reading means for illuminating a document laid on said platen to guide a reflection from said document to said photoconductive element wherein the charging means and optical reading means of the reference latent image potential forming means are the same as the charging means and optical reading means of the record latent image potential forming means.

5. A device as claimed in claim 4 wherein the optical sensing means comprises an optical sensing read position updating means for updating an optical sensing read position at which a reflection from the photoconductive element is to be picked up.

6. A device as claimed in claim 5, wherein the reference pattern is positioned on a surface which is substantially contiguous with a surface of the platen which faces the optical reading means.

7. A device as claimed in claim 6, wherein the reference pattern is located upstream of the leading end of the document laid on the platen with regard to updating of the uptical read position.

8. A device as claimed in claim 7, wherein said control means, when the record latent image potential form timing is reached, applies a command for start updating the optical read position to the optical read position updating means.

9. A device as claimed in claim 1, wherein the developer comprises a mixture of toner and carrier for carrying said toner, and the developer density adjusting means comprises a toner supply means for supplying said toner.

10. A device as claimed in claim 9, wherein the control means controls the toner supply means based on density of the visible image of the reference latent image potential which is sensed by the optical sensing means, thereby adjusting a mixture ratio of the toner and carrier.

* * * * *